US005210064A

United States Patent [19]

Shon Baker et al.

[11] Patent Number: 5,210,064

[45] Date of Patent: May 11, 1993

[54] STABILIZATION OF THERMAL IMAGES

[75] Inventors: Rita S. Shon Baker, Brookline; Larry C. Takiff, Arlington, both of Mass.

[73] Assignee: Polaroid Corporation, Cambridge, Mass.

[21] Appl. No.: 795,102

[22] Filed: Nov. 20, 1991

[51] Int. Cl.[5] ..... B41M 5/30

[52] U.S. Cl. ..... 503/201; 106/21 R; 427/151; 430/200; 503/202; 503/204; 503/209; 503/218; 503/221

[58] Field of Search ..... 430/200, 201; 503/201, 503/202, 217, 218, 219, 225, 204, 209, 221; 106/21; 427/150–152

[56] References Cited

U.S. PATENT DOCUMENTS

| | | | |
|---|---|---|---|
| 3,445,234 | 5/1969 | Cescon et al. | 96/90 |
| 3,658,543 | 4/1972 | Gerlach, Jr. et al. | 96/90 |
| 4,097,288 | 6/1978 | Lawton | 106/21 |
| 4,342,473 | 8/1982 | Chang | 282/27.5 |
| 4,423,139 | 12/1983 | Isbrandt et al. | 430/338 |
| 4,508,811 | 4/1985 | Gravesteijn et al. | 430/270 |
| 4,531,141 | 7/1985 | Sagawa | 346/209 |
| 4,602,263 | 7/1986 | Borrer et al. | 346/201 |
| 4,622,286 | 11/1986 | Sheets | 430/343 |
| 4,631,084 | 12/1986 | Sagawa | 106/21 |
| 4,716,424 | 12/1987 | Petitpierre et al. | 503/210 |
| 4,720,449 | 1/1988 | Borrer et al. | 430/338 |
| 4,720,450 | 1/1988 | Ellis | 430/339 |
| 4,745,046 | 5/1988 | Borrer et al. | 430/332 |
| 4,826,976 | 5/1989 | Borrer et al. | 544/58.4 |
| 4,891,297 | 1/1990 | Takashima et al. | 430/177 |
| 4,960,901 | 10/1990 | Borrer et al. | 548/207 |
| 4,990,486 | 2/1991 | Kamosaki et al. | 503/227 |
| 4,992,414 | 2/1991 | Kishida et al. | 503/227 |
| 5,024,699 | 6/1991 | Llyama et al. | 106/21 |
| 5,024,988 | 6/1991 | Zink et al. | 503/212 |
| 5,032,567 | 7/1991 | Ohtsubo et al. | 503/209 |

*Primary Examiner*—Pamela R. Schwartz
*Attorney, Agent, or Firm*—David J. Cole

[57] ABSTRACT

The addition, to a thermal imaging medium comprising a color-forming compound which undergoes a change of color upon heating above a color-forming temperature for a color-forming time, the color-forming compound being of the cyclic sulfonamide type described in U.S. Pat. Nos. 4,720,449 and 4,960,901.

of a quinone or hydroquinone increases the sensitivity of the imaging medium and helps to prevent fading of images produced therefrom while the images are being projected.

36 Claims, 13 Drawing Sheets

STABILIZATION OF THERMAL IMAGES

BACKGROUND OF THE INVENTION

1. Field of the Invention

This invention relates to stabilization of thermal images. More particularly, this invention relates to thermal imaging media, processes for forming images and imaged media in which a quinone or hydroquinone is used to reduce fading of the images during projection of the image by passage of visible radiation through the image. The sensitivity of the thermal imaging media of the invention is improved by the incorporation of the quinone or hydroquinone therein.

2. References to Related Applications

Copending U.S. patent application Ser. Nos. 07/695,641; 07/696,196 and 07/695,932 (now U.S. Pat. No. 5,153,169), all filed May 6, 1991 and all assigned to the same assignee as the present application, describe and claim imaging media comprising a color-forming layer comprising a thermal color-forming composition adapted to undergo a change of color upon increase in the temperature of the color-forming layer above a color-forming temperature for a color-forming time. Preferred imaging media described in these three applications are substantially as shown in FIG. 1 of the accompanying drawings and comprise three separate color-forming layers containing yellow, cyan and magenta thermal color-forming compositions; each of these color-forming compositions comprises a color-forming compound which can produce the desired color and an infra-red absorber capable of absorbing infra-red radiation and thereby generating heat in the color-forming layer. The three color-forming layers use infra-red absorbers absorbing at differing wavelengths so that each color-forming layer can be imaged independently; for example, specific imaging media disclosed in these three applications use infra-red absorbers having peak absorptions at approximately 792, 822 and 869 nm.

Copending U.S. application Ser. No. 07/696,222, filed May 6, 1991, and assigned to the same assignee as the present application, describes and claims certain processes for the synthesis of bis(heterocyclic) dyes, especially asymmetric dyes in which the two heterocyclic nuclei differ. These processes are useful for the synthesis of certain infra-red dyes used in the imaging medium of the present invention shown in FIG. 1 of the accompanying drawings.

Copending U.S. application Ser. No. 07/795,088, of even date herewith and assigned to the same assignee as the present application, describes and claims certain bis(benzpyrylium) infra-red dyes, including the croconate dye used in the thermal imaging medium described below with reference to FIG. 1 of the accompanying drawings.

Copending U.S. application Ser. No. 07/795,034, of even date herewith and assigned to the same assignee as the present application, describes and claims certain amino-substituted squarylium infra-red dyes, including the dyes of Formulae IR2, IR3 and IR5 used in the thermal imaging medium described below with reference to FIG. 1 of the accompanying drawings.

Copending U.S. application Ser. No. 07/696,151, filed May 6, 1991, and assigned to the same assignee as the present application, describes and claims leuco dyes which can be used in the imaging medium of the present invention.

Copending U.S. application Ser. No. 07/277,014 (now abandoned), filed Nov. 28, 1988, and assigned to the same assignee as the present application, describes and claims the yellow leuco dye used in the imaging medium of the present invention shown in FIG. 1 of the accompanying drawings.

U.S. Pat. No. 5,063,090, assigned to the same assignee as the present application, describes and claims quinophthalone leuco dyes which can be used in the imaging medium of the present invention.

Copending U.S. application Ser. No. 07/795,101 of even date herewith and assigned to the same assignee as the present application describes and claims thermal imaging media generally similar to those of the present invention, but in which certain metal cations, rather than quinones and hydroquinones, are used to increase the sensitivity of, and reduce fading of images formed from, the imaging media.

The disclosures of all the aforementioned copending applications are herein incorporated by reference.

3. Description of the Prior Art

As already indicated, imaging media are known which have at least one color-forming layer comprising a color-forming composition adapted to undergo a change of color (from colorless to colored, from colored to colorless, or from one color to another) upon increase in the temperature of the color-forming layer above a color-forming temperature for a color-forming time. The color change in such media need not be supplied by applying heat directly to the medium; the color-forming composition may comprise a color-forming compound (also referred to herein as a "leuco dye") which undergoes a change of color upon heating above a color-forming temperature, and an absorber capable of absorbing actinic (usually infra-red) radiation and thereby generating heat in the color-forming layer. When such a medium is exposed to appropriate actinic radiation, this radiation is absorbed by the absorber, thereby heating the color-forming compound and causing it to undergo its color change. Many such thermal imaging media have the advantage over conventional silver halide media of not requiring a post-exposure developing step. Such thermal imaging media also have the advantage that they are essentially insensitive to visible light, so that they can be handled under normal lighting conditions.

For example U.S. Pat. Nos. 4,602,263 and 4,826,976 both describe thermal imaging systems for optical recording and particularly for forming color images. These thermal imaging systems rely upon the irreversible unimolecular fragmentation of one or more thermally unstable carbamate moieties of an organic compound to effect a visually discernible color shift. U.S. Pat. Nos. 4,720,449 and 4,960,901 describe a similar imaging system in which the color-developing component is a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to the meso carbon atom and the nitrogen atom being bound to a group with a masked acyl substituent that undergoes fragmentation upon heating to liberate the acyl group for effecting intramolecular acylation of the nitrogen atom to form a new group in the ortho position that cannot bond to the meso carbon atom, whereby the di- or triarylmethane compound is rendered colored. Other thermal imaging systems using di- or triarylmethane compounds are described in U.S. Pat. No. 4,720,450, while U.S. Pat. No. 4,745,046 describes a thermal imaging system using as color-forming co-reactants a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which, upon heating and contacting the di- or triarylmethane compound, undergoes a bimolecular nucleophilic substitution reaction with the nucleophilic moiety to form a colored, ring-opened di- or triarylmethane compound.

The aforementioned patents describe a preferred form of imaging medium for forming multicolor images; in this preferred imaging medium, three separate color-forming layers, capable of forming yellow, cyan and magenta dyes, respectively, are superposed on top of one another. Each of the three color-forming layers has an infra-red absorber associated therewith, these absorbers absorbing at differing wavelengths, for example 760, 820 and 880 nm. This medium is imagewise exposed to three lasers having wavelengths of 760, 820 and 880 nm. (In the present state of technology, solid state diode lasers emitting at about 760 to 1000 nm provide the highest output per unit cost. Since most of the color-forming materials described in the aforementioned patents do not have high extinction coefficients within this wavelength range, it is necessary to include the infra-red absorbers with the leuco dyes in order to ensure efficient absorption of the laser radiation and hence efficient heating of the leuco dye.) The resultant imagewise heating of the color-forming layers causes the leuco dyes to undergo color changes in the exposed areas, thereby producing a multicolored image, which needs no development.

This preferred type of imaging medium is capable of very high resolution images; for example, the medium can readily be used to produce a 2K line 35 mm slide (i.e., a slide having 2000 pixels in each line parallel to the long edges of the slide). However, it has been found that images produced from certain leuco dyes, especially those described in the aforementioned U.S. Pat. Nos. 4,720,449 and 4,960,901, tend to fade and/or undergo color shifts when those images are projected using powerful conventional slide projectors, for example xenon arc projectors, for extended periods of time. Obviously, fading and color shifts are undesirable and the need therefore exists for ways of preventing or at least reducing such fading and color shifts.

The thermal color-forming reactions described in the aforementioned patents do not provide any amplification such as occurs in silver halide based imaging media, and consequently the media are relatively insensitive; typically, the thermal media require energy inputs of about 1 J/cm$^2$ per color-forming layer to achieve maximum transmission optical densities around 3.0, which are needed for acceptable slides. Accordingly, it would be advantageous to improve the sensitivity of these thermal imaging media so as to improve the speed of image formation and/or reduce the power requirements for the energy source used for imaging.

It has now been found that quinones and hydroquinones reduce the fading and color shifts which otherwise occur during projection of thermal images produced as described in the aforementioned U.S. Pat. Nos. 4,720,449 and 4,960,901, and also serve to increase the sensitivity of the thermal imaging media described in these patents.

SUMMARY OF THE INVENTION

Accordingly, this invention provides a thermal imaging medium comprising at least one imaging layer, the imaging layer comprising a color-forming compound which undergoes a change of color upon heating above a color-forming temperature for a color-forming time, the color-forming compound being of the formula:

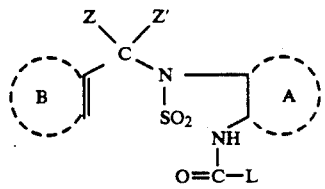

(I)

and forming after its change in color a dye compound of the formula:

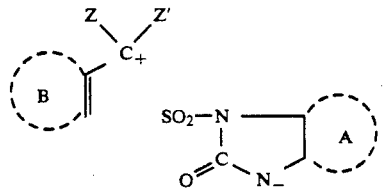

(II)

in which formulae:

rings A and B are aromatic nuclei;

Z and Z', which may be linked other than via the meso carbon atom, represent the moieties sufficient to complete the auxochromophoric system of a diarylmethane or a triarylmethane dye in the dye compound, Z and Z' being such that the dye compound has absorption in the visible region;

L is a leaving group which is removed on heating; and the broken line between the $SO_2$ group and ring B denotes that the sulfonamide ring in the color-forming compound may be 5- or 6-membered, the imaging layer further comprising a quinone or hydroquinone.

The term "meso carbon atom" is used herein in its conventional sense to refer to the carbon atom bonded to the groups Z and Z' in the compounds of Formula I and II.

The term "hydroquinone" is used herein generically to refer to any aromatic system in which a single phenyl ring bears two hydroxyl groups in positions para to one another. Thus, the term as used herein includes not only derivatives of hydroquinone itself in which the phenyl ring is substituted, for example 2-phenyl-5-methylhydroquinone, but also compounds in which the phenyl ring bearing the hydroxyl groups is fused to one or more other aromatic rings, for example naphthohydroquinone. The term "quinone" is used in a corresponding manner.

This invention also provides a process for forming an image, the process comprising:

providing a thermal imaging medium having at least one imaging layer, the imaging layer comprising a color-forming compound of Formula I above and a quinone or hydroquinone;

imagewise heating the imaging layer above a color-forming temperature for a color-forming time, thereby causing, in heated regions of the image, at least part of the color-forming compound to be converted to a dye compound of Formula II above, thereby forming an image.

Finally, this invention provides an imaged medium having imagewise colored and substantially uncolored areas, the substantially uncolored areas of the image comprising a color-forming compound which undergoes a change of color upon heating above a color-forming temperature for a color-forming time, the color-forming compound being of Formula I above and the colored areas of the image comprising a dye compound of Formula II above, the colored and substantially uncolored areas further comprising a quinone or hydroquinone.

DETAILED DESCRIPTION OF THE INVENTION

Figure 1:
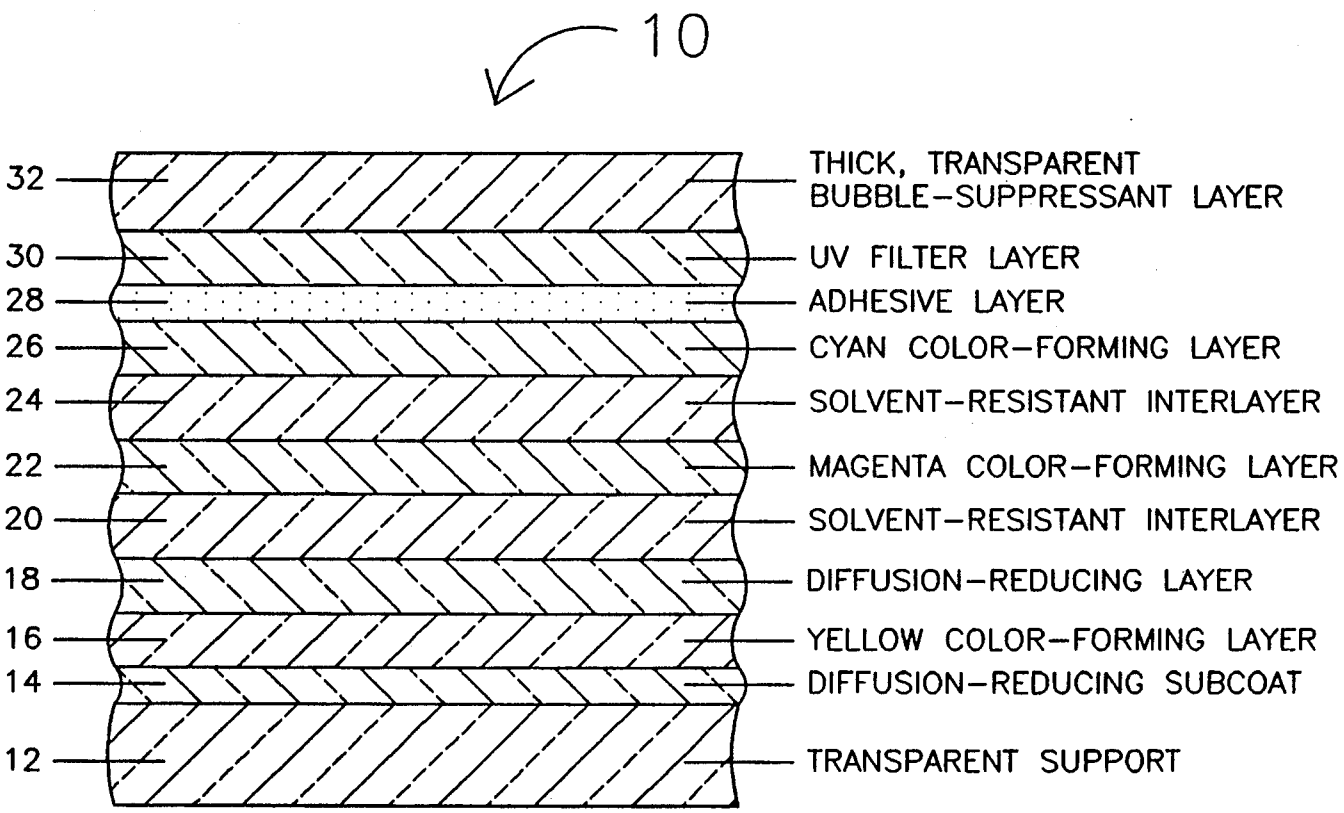
FIG. 1 of the accompanying drawings shows a schematic cross-section through a preferred imaging medium of the present invention.

As already mentioned, the thermal imaging medium of the present invention comprises a color-forming compound of Formula I (which, upon heating above a color-forming temperature for a color-forming time, forms a dye compound of Formula II) and a quinone or hydroquinone. More than one quinone or hydroquinone, and mixtures of quinones and hydroquinones, may be employed if desired.

In general, it is preferred to use a hydroquinone rather than a quinone in the imaging medium and process of the present invention, since the hydroquinones seem to be somewhat more effective. Hydroquinones having an electron withdrawing substituent on the aromatic ring bearing the two hydroxyl groups are preferred, since they have been found to be more effective in preventing fading of images produced using the present process; the effectiveness of the hydroquinones in preventing image fading correlates well with the electron withdrawing ability of the substituent(s), but does not correlate with the redox potentials of the hydroquinones. The or each electron withdrawing substituent may be, for example, a halogen atom or an alkyl group. Specific preferred hydroquinones for use in the present medium and process are chlorohydroquinone, 2,5-dichlorohydroquinone, 2-methyl-5-phenylhydroquinone, phenylhydroquinone and 2,5-di-t-butylhydroquinone.

The imaging layer used in the imaging medium of the present invention normally contains a polymeric binder and the quinone or hydroquinone used must of course be chosen so that it can be dispersed at the required concentration in the polymeric binder used, though in practice it is not usually difficult to disperse quinones and hydroquinones in the binders normally used in thermal imaging media. In general, it is recommended that quinones and hydroquinones containing strongly acid substituents be avoided, since these acid substituents may cause undesirable color formation of the color-forming compound during storage at ambient temperature.

The rate of projector fading and/or color shifting experienced with the imaged medium of the present invention varies considerably with the polymeric binder used in the imaging layer, and thus the optimum amount of quinone or hydroquinone to be used in the imaging layer is best determined empirically. In general, however, it is preferred that at least about 0.25, and desirably at least about 0.5, mole of quinone or hydroquinone be provided per mole of color-forming compound. It should be noted that there is a (quinone or hydroquinone)/color-forming compound ratio above which further increases in the ratio do not appear to produce further increases in sensitivity or protection against projector fading, although the exact ratio at which this occurs will vary with the specific quinone or hydroquinone and color-forming compound used.

The color change undergone by the color-forming compound during imaging of the thermal imaging medium of the present invention may be from colorless to colored, or from one color to another), but in general it is preferred that the color change be from colorless to colored. The term "colored" as used herein is not restricted to colors visible to the human eye; although the present invention may find its chief application in imaging media intended for the production of visible images, it may also be used in imaging media intended for the production of "images" which can only be read at non-visible (for example, infra-red) wavelengths.

Preferred color-forming compounds of Formula I are those in which Z and Z' each comprise a benzene ring, Z and Z' being linked via an oxygen atom bonded to the two benzene rings at positions ortho to the meso carbon atom, so that the Z—C—Z' grouping forms a xanthene nucleus. Especially preferred compounds of this type are those in which the benzene rings of Z and Z' carry substituted amino groups at positions para to the meso carbon atom. It is also preferred that, in the color-forming compounds of Formula I, ring A comprise a benzene ring bearing, at its position para to the sulfonamide nitrogen atom, a carbamate moiety.

Two specific preferred color-forming compounds of Formula I are:

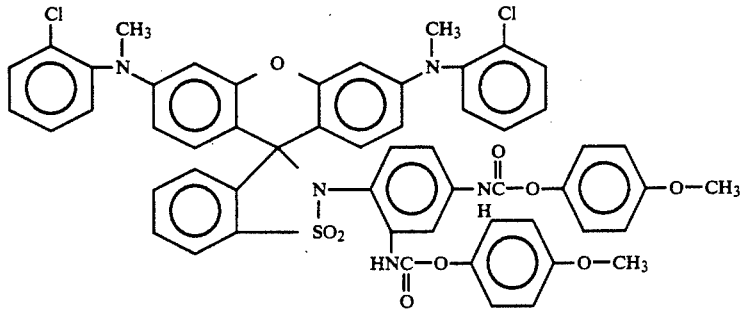

(III)

and

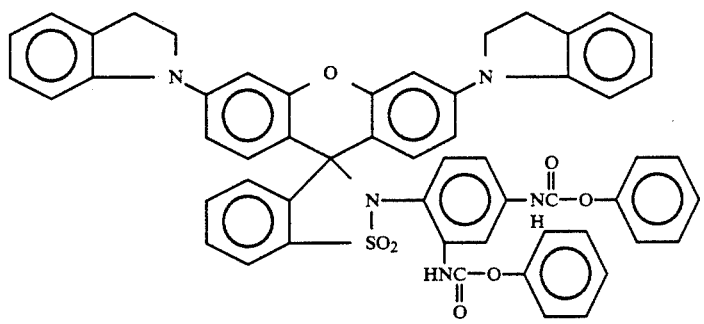

(IV)

Except for the presence of the quinone or hydroquinone, the various layers of the imaging medium of the present invention, and the techniques used for exposing the medium, can be those used in the aforementioned U.S. patents and applications. Thus, in carrying out the imaging method of the present invention, heat may be applied or induced imagewise in a variety of ways. Preferably, selective heating is produced in the color-forming layer itself by the conversion of electromagnetic radiation into heat, and preferably the light source is a laser emitting source such as a gas laser or semiconductor laser diode, preferably an infra-red laser. The use of a laser beam is not only well suited for recording in a scanning mode but by utilizing a highly concentrated beam, radiant energy can be concentrated in a small area so that it is possible to record at high speed and high density. Also, it is a convenient way to record data as a heat pattern in response to transmitted signals, such as digitized information.

Since most of the color-forming compounds used in the present imaging medium do not absorb strongly in the infra-red, in the imaging medium of the present invention the imaging medium desirably comprises an absorber capable of absorbing infra-red radiation and thereby generating heat in the imaging layer. The heat thus generated is transferred to the color-forming compound to initiate the color-forming reaction and effect the change in the absorption characteristics of the color-forming compound from colorless to colored. Obviously, the infra-red absorber (which may also be referred to hereinafter as an "infra-red dye") should be in heat-conductive relationship with the color-forming compound, for example, in the same layer as the color-forming compound or in an adjacent layer. Though an inorganic compound may be employed, the infra-red absorber preferably is an organic compound, such as a cyanine, merocyanine, squarylium, thiopyrylium or benzpyrylium dye, and preferably, is substantially non-absorbing in the visible region of the electromagnetic spectrum so that it will not contribute any substantial amount of color to the $D_{min}$ areas, i.e., the highlight areas of the image. The light absorbed by the respective infra-red absorbers is converted into heat and the heat initiates the reaction to effect the formation of colored compounds in the color-forming layers. Since this type of imaging medium is imaged by infra-red radiation rather than by direct heating, a high resolution image is more easily achieved.

An especially preferred form of imaging medium of the present invention has at least two imaging layers, the at least two imaging layers comprising color-forming compounds arranged to produce dye compounds having differing colors, and comprising absorbers absorbing at differing wavelengths. The infra-red absorbers are desirably selected such that they absorb radiation at different predetermined wavelengths above 700 nm sufficiently separated so that each color-forming layer may be exposed separately and independently of the others by using infra-red radiation at the particular wavelengths selectively absorbed by the respective infra-red absorbers. As an illustration, three color-forming layers containing yellow, magenta and cyan color-forming compounds could have infra-red absorbers associated therewith that absorb radiation at 792 nm, 848 nm and 926 nm, respectively, and could be addressed by laser sources, for example, infra-red laser diodes, emitting laser beams at these respective wavelengths so that the three color-forming layers can be exposed independently of one another. While each layer may be exposed in a separate scan, it is usually preferred to expose all of the color-forming layers in a single scan using multiple laser sources of the appropriate wavelengths. Instead of using superimposed imaging layers, the color-forming compounds and associated infra-red absorbers may be arranged in an array of side-by-side dots or stripes in a single recording layer. In such multicolor imaging media, the color-forming compounds may comprise the subtractive primaries yellow, magenta and cyan or other combinations of colors, which combinations may additionally include black. The leuco dyes generally are selected to give the subtractive colors cyan, magenta and yellow, as commonly employed in photographic processes to provide full natural color. A full color imaging medium of this type having three imaging layers is described below with reference to FIG. 1 of the accompanying drawings.

Where imagewise heating is induced by converting light to heat, the imaging medium may be heated prior to or during exposure. This may be achieved using a heating platen or heated drum or by employing an additional laser source or other appropriate means for heating the medium while it is being exposed.

The imaging medium of the present invention can be prepared in a manner similar to the imaging media described in the aforementioned U.S. patents and applications. Typically, the color-forming compound and any other components of the imaging layer (for example, a polymeric binder and an infra-red absorber) are dispersed in an appropriate solvent, and the resultant liquid dispersion is coated onto a support, generally a polymer film, using conventional coating equipment, and the resultant liquid film dried to produce the imaging layer. Rather than a solution coating, the layer may be applied as a dispersion or an emulsion. The coating composition also may contain dispersing agents, plasticizers, defoaming agents, hindered amine light stabilizers and coating aids. In forming the imaging layer(s) and the interlayers or other layers, temperatures should be maintained below levels that will cause the color-forming reactions to occur rapidly so that the color-forming compounds will not be prematurely colored.

To incorporate a quinone or hydroquinone into the imaging layer in accordance with the present invention, the quinone or hydroquinone is simply dispersed in the liquid dispersion with the other components of the imaging layer. Thus, the present invention does not require extensive changes in the equipment or processes used to produce the thermal imaging medium.

Apart from the presence of the quinone or hydroquinone, the imaging medium of the present invention may contain additional layers and components as described in the aforementioned U.S. patents and applications. Thus, as already indicated, the imaging medium typically includes a support on which the imaging layer(s) are deposited. The support should be sufficiently thick as to permit easy handling of the imaging medium, and may be any material that substantially retains its dimensional stability during imaging. Desirably, the support has a thickness of at least about 50 μm. The support must be sufficiently transparent that it does not raise excessively the $D_{min}$ of the final image. If it is desired to image through the support, the support must also be sufficiently transparent that it does not interfere with the imaging process, and is preferably non-birefringent, since if the medium is imaged through the support, a birefringent support may cause difficulties in focussing the laser (or other radiation source) at the proper level within the imaging medium. Suitable supports include polyethylene, polypropylene, polycarbonate, cellulose acetate, and polystyrene. The preferred material for the support is a polyester, desirably poly(ethylene terephthalate).

Examples of binders that may be used include poly(vinyl alcohol), poly(vinyl pyrrolidone), methyl cellulose, cellulose acetate butyrate, styrene-acrylonitrile copolymers, copolymers of styrene and butadiene, poly(methyl methacrylate), copolymers of methyl and ethyl acrylate, poly(vinyl acetate), poly(vinyl butyral), polyurethane, polycarbonate and poly(vinyl chloride). It will be appreciated that the binder selected should not have any adverse effect on the leuco dye incorporated therein and may be selected to have a beneficial effect. Also, the binder should be substantially heat-stable at the temperatures encountered during image formation and it should be transparent so that it does not interfere with viewing of the color image. Where electromagnetic radiation is employed to induce imagewise heating, the binder also should transmit the light intended to initiate image formation.

As explained in more detail in the aforementioned copending U.S. application Ser. No. 07/696,196, in some imaging media of the type described in the aforementioned patents, there is a tendency for one or more of the colored materials produced during imaging to diffuse out of their color-forming layers, but such undesirable diffusion of colored material can be reduced or eliminated by dispersing the leuco dye in a first polymer having a glass transition temperature of at least about 50° C., preferably at least about 75° C., and most preferably at least about 95° C., and providing a diffusion-reducing layer in contact with the color-forming layer, this diffusion-reducing layer comprising a second polymer having a glass transition temperature of at least about 50° C. and being essentially free from the color-forming composition. Desirably, the diffusion-reducing layer has a thickness of at least about 1 μm. The first polymer is desirably an acrylic polymer, preferably poly(methyl methacrylate).

As discussed in the aforementioned U.S. application Ser. No. 07/695,641, certain color-forming compounds show a tendency to form bubbles during imaging. Accordingly, the imaging medium of the present invention advantageously comprises a bubble-suppressant layer superposed on the imaging layer and having a thickness of at least about 10 μm, such that, upon imagewise increase in the temperature of the imaging layer above the color-forming temperature for the color-forming time, in heated regions the imaging layer undergoes its change of color but remains essentially free from bubbles.

Other layers which may be included in the imaging medium of the present invention are, for example, a subbing layer to improve adhesion to a support, interlayers for thermally insulating the imaging layers from each other, an ultra-violet screening layer having an ultraviolet absorber therein, or other auxiliary layers. To give good protection against ultra-violet radiation, ultra-violet screening layers are desirably provided on both sides of the imaging layer(s); conveniently, one of the ultra-violet screening layers is provided by using as the support a polymer film containing an ultra-violet absorber, and such absorber-containing films are available commercially.

A preferred embodiment of the invention will now be described, though by way of illustration only, with reference to FIG. 1 of the accompanying drawings, which is a schematic cross-section through an imaging medium of the present invention. The thicknesses of the various layers shown in the drawing are not to scale.

The imaging medium (generally designated 10) shown in the drawing is intended for use in the production of transparencies and comprises a substantially transparent support 12 formed of 4 mil (101 μm) poly(ethylene terephthalate) (PET) film incorporating an ultra-violet absorber. Appropriate PET films are readily available commercially, for example as P4C1A film from DuPont de Nemours., Wilmington, Del.

The imaging medium 10 also comprises a diffusion-reducing subcoat 14 approximately 1 μm thick formed from a 10:1 w/w mixture of a water-dispersible styrene acrylic polymer (Joncryl 538 sold by S.C. Johnson & Son, Inc., Racine, Wis. 53403) and a water-soluble acrylic polymer (Carboset 526 sold by The B.F. Goodrich Co., Akron, Ohio 44313). The presence of the minor proportion of water-soluble acrylic polymer reduces the tendency for the layer 14 to crack during the coating process. The diffusion-reducing subcoat 14, which has a glass transition temperature of approximately 55° C., serves the function of a conventional subcoat, namely increasing the adhesion of the imaging layer 16 (described in detail below) to the support 12. The subcoat 14 also serves to reduce or eliminate migration of dye compound from the imaging layer 16 after imaging; if a conventional subcoat were employed in place of the diffusion-reducing subcoat 14, diffusion of the dye compound from the layer 16 into the subcoat after imaging might cause loss of sharpness of the image. The subcoat 14 is coated onto the support 12 from an aqueous medium containing the water-dispersible and water-soluble polymers.

A yellow imaging layer 16 is in contact with the diffusion-reducing subcoat 14. This imaging layer 16 is approximately 5 μm thick and comprises approximately 47.5 parts by weight of a leuco dye of the formula:

(LDI)

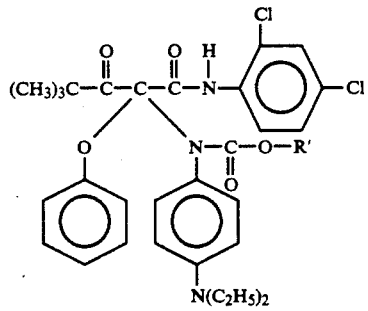

in which R' is a tertiary butyl group (the compounds in which R' is an isobutyl or benzyl group may alternatively be used), 1.6 parts by weight of an infra-red dye of the formula:

(IR1)

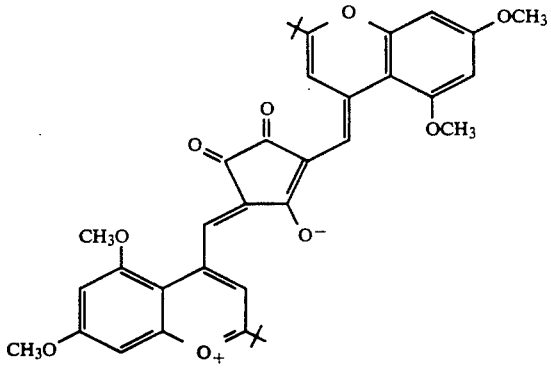

(prepared as described in the aforementioned copending U.S. application Ser. No. 07/795,038; essentially, this dye is produced by condensing two moles of a 2-(1,1-dimethylethyl)-5,7-dimethoxy-4-methylbenzpyrylium salt with a croconate salt), 3.3 parts by weight of a hindered amine stabilizer (HALS-63, sold by Fairmount Chemical Co.), and 47.5 parts by weight of a poly(methyl methacrylate) binder (Elvacite 2021, sold by DuPont de Nemours, Wilmington, Del.; this material is stated by the manufacturer to be a methyl methacrylate/ethyl acrylate copolymer, but its glass transition temperature approximates that of poly(methyl methacrylate)). This binder has a glass transition temperature of approximately 100° C. The imaging layer 16 is applied by coating from a mixture of heptanes and methyl ethyl ketone.

Superposed on the yellow imaging layer 16 is a diffusion-reducing layer 18, which, like the first diffusion-reducing layer 14, serves to prevent migration of dye compound from the yellow imaging layer 16 on storage after imaging. The diffusion-reducing layer 18, which is approximately 2 μm thick, is formed of a water-dispersible styrene acrylic polymer (Joncryl 138 sold by S.C. Johnson & Son, Inc., Racine, Wis. 53403), and is coated from an aqueous dispersion. This layer has a glass transition temperature of approximately 60° C.

The next layer of the imaging medium 10 is a solvent-resistant interlayer 20 approximately 4.6 μm thick and composed of a major proportion of partially cross-linked polyurethane (NeoRez XR-9637 polyurethane sold by ICI Resins US, Wilmington, Mass.) and a minor proportion of poly(vinyl alcohol) (Airvol 540, sold by Air Products and Chemicals, Inc., Allentown, Penna. 18195). This solvent-resistant interlayer 20 is coated from an aqueous dispersion. The interlayer 20 not only helps to thermally insulate the imaging layers 14 and 22 (described below) from one another during imaging, but also prevents disruption and/or damage to the yellow imaging layer 16 and the diffusion-reducing layer 18 during coating of the magenta imaging layer 22. Since the yellow imaging layer 16 and the magenta imaging layer 22 are both coated from organic solution, if a solvent-resistant interlayer were not provided on the layer 16 before the layer 22 was coated, the organic solvent used to coat the layer 22 might disrupt, damage or extract leuco dye or infra-red absorber from the layer 16. Provision of the solvent-resistant interlayer 20, which is not dissolved by and does not swell in the organic solvent used to coat the layer 22, serves to prevent disruption of or damage to the layer 16 as the layer 22 is coated. Furthermore, the solvent-resistant interlayer 20 serves to prevent the magenta leuco dye, infra-red dye and hindered amine light stabilizer from the layer 22 sinking into the diffusion-reducing layer 18 and the yellow imaging layer 16 as the layer 22 is being coated.

Superposed on the solvent-resistance interlayer 20 is the magenta imaging layer 22, which is approximately 3 μm thick and comprises approximately 47.25 parts by weight of a leuco dye of Formula III above (this leuco dye may be prepared by the methods described in the aforementioned U.S. Pat. Nos. 4,720,449 and 4,960,901), approximately 5.02 parts by weight of chlorohydroquinone (thus giving a leuco dye: chlorohydroquinone molar ratio of about 1:0.75), 1.62 parts by weight of an infra-red dye of the formula:

(IR2)

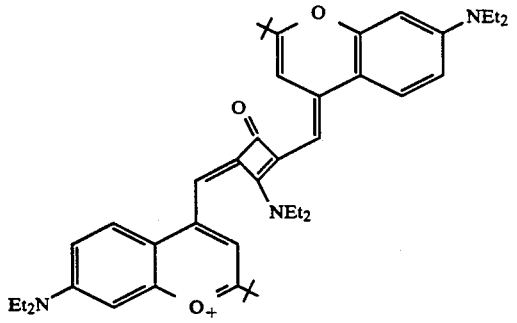

(which may be prepared by the process described in the aforementioned U.S. application Ser. No. 07/795,034; essentially, this dye is produced by reacting a compound of the formula:

(V)

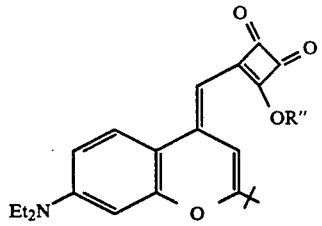

in which R is a halogen atom or an alkyl group, with diethylamine to introduce the —$NEt_2$ group on the squarylium ring, and then reacting the product with the 4-methylbenzpyrylium salt to give the final infra-red dye of Formula IR2), 3.6 parts by weight of a hindered amine stabilizer (HALS-63), 0.27 parts by weight of a wetting agent, and 47.25 parts by weight of a polyurethane binder (Estane 5715, supplied by The B.F. Goodrich Co., Akron, Ohio 44313). The imaging layer 22 is applied by coating from a cyclohexanone/methyl ethyl ketone mixture.

(Alternatively, the infra-red dye of Formula IR2 above may be replaced by the dye of formula:

(IR3)

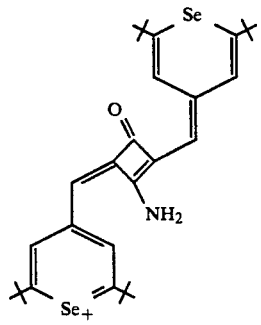

Figure 4:
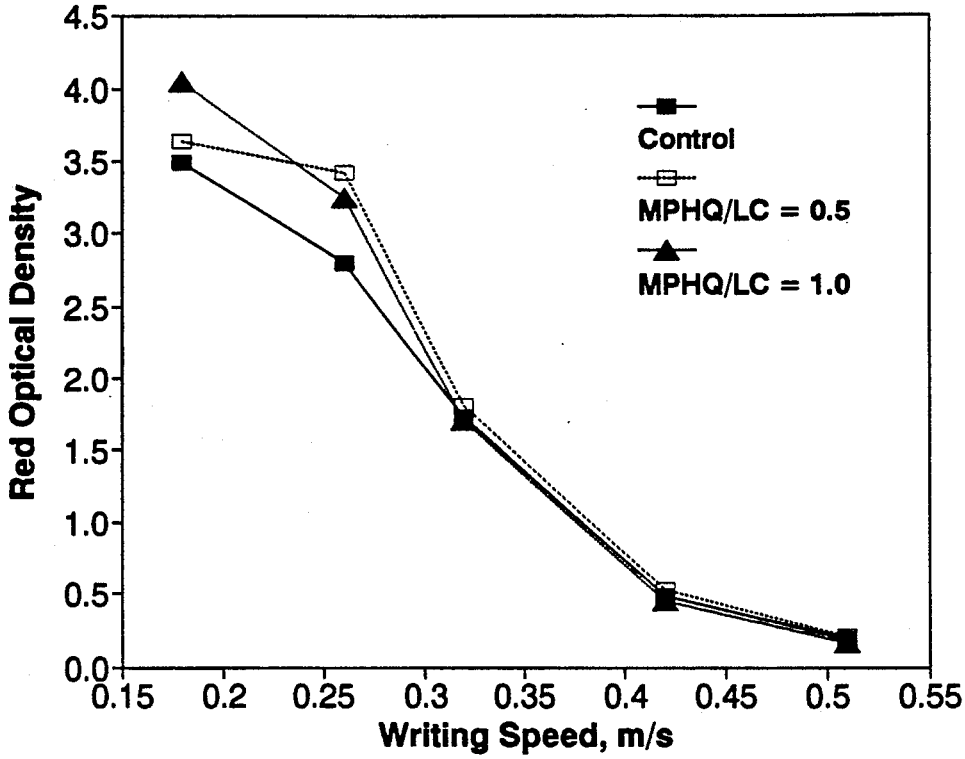
FIG. 4 shows the effect of 2-methyl-5-phenylhydroquinone in increasing the sensitivity of a thermal imaging medium containing a cyan color-forming compound, as described in Example 2 below.

(used in the form of its tetrafluoroborate salt) (this infra-red dye may be prepared by the process analogous to that used to prepare the infra-red dye of Formula IR2 above using the corresponding selenopyrylium squaric acid derivative and ammonia to introduce the amino group, followed by condensation of the product with a selenopyrylium salt; to prepare the selenopyrylium squaric acid derivative, the corresponding selenopyrylium salt is substituted for the benzpyrylium salt IV in the reactions shown in FIG. 4).)

On the imaging layer 22 is coated a second solvent-resistant interlayer 24 which is formed from the same material, and coated in the same manner as, the solvent-resistant interlayer 20.

Superposed on the second solvent-resistant interlayer 24 is a dyan imaging layer 26, which is approximately 3 μm thick and comprises approximately 49.5 parts by weight of a leuco dye of Formula IV above (this leuco dye may be prepared by the methods described in the aforementioned U.S. Pat. Nos. 4,720,449 and 4,960,901), approximately 5.86 grams of chlorohydroquinone (thus giving a leuco dye: chlorohydroquinone molar ratio of about 1:0.75), 1.62 parts by weight of an infra-red dye of the formula:

(IR4)

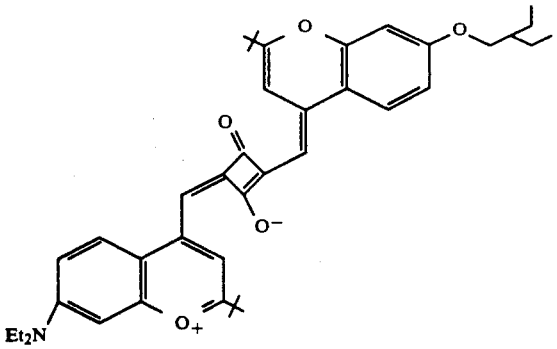

(which is preferably prepared by the process described in the aforementioned copending U.S. application Ser. No. 07/696,222; essentially this process comprises reacting a diester, diacid chloride or monoester monoacid chloride of squaric acid with a 2-(1,1-dimethylethyl)7-diethylamino-4-methylbenzpyrylium salt and hydrolysing to produce a benzpyryliummethylidene compound, and then reacting this compound with a 7-alkoxy-2-(1,1-dimethylethyl)-4-methylbenzpyrylium salt to give the final infra-red dye), 0.2 parts of a wetting agent, and 49.5 parts by weight of a polyurethane binder (Estane 5715). The imaging layer 26 is applied by coating from methyl ethyl ketone.

(Alternatively, the infra-red dye of Formula IR4 above may be replaced by the dye of formula:

(IR5)

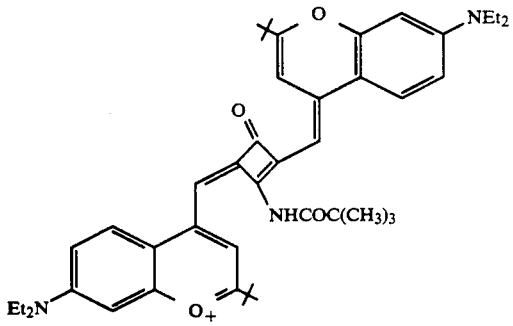

(which may be prepared by a process analogous to that used to prepare the infra-red dye of Formula IR2 above, by reacting the intermediate of Formula V above with ammonia to introduce an amino group on the squarylium ring, then reacting the product with a 4-methylbenzpyrylium salt to produce the amino squarylium dye, and finally reacting this amino squarylium dye with pivaloyl chloride to produce the final pivaloylamino group on the squarylium ring).

As already indicated, the layers 14–26 of the imaging medium 10 are produced by coating on to the transparent support 12. However, the remaining layers of the imaging medium 10, namely the transparent bubble-suppressant layer 32, the ultraviolet filter layer 30 and the adhesive layer 28 are not coated on to the layer 26 but rather are prepared as a separate unit and then laminated to the remaining layers of the medium.

The transparent bubble-suppressant layer 32 is a 1.75 mil (44 μm) PET film, a preferred film being that sold as ICI 505 film by ICI Americas, Inc., Wilmington, Del. The bubble-suppressant layer 32 prevents the formation of bubbles in the imaging layers 16, 22 and 26 of the imaging medium 10 during imaging.

The ultraviolet filter layer 30 serves to protect the imaging layers 16, 22 and 26 from the effects of ambient ultraviolet radiation. It has been found that the leuco dyes are susceptible to undergoing color changes when exposed to ultraviolet radiation during storage before or after imaging; such color changes are obviously undesirable since they increase the $D_{min}$ of the image and may distort the colors therein. The ultraviolet filter layer 30 is approximately 5 μm thick and comprises approximately 83 percent by weight of a poly(methyl methacrylate) (Elvacite 2043, sold by DuPont de Nemours, Wilmington, Mass.), 16.6 percent by weight of an ultraviolet filter (Tinuvin 328 sold by Ciba-Geigy, Ardsdale, N.Y.) and 0.4 percent by weight of a wetting agent. The ultraviolet filter layer 30 is prepared by coating on to the bubble-suppressant layer 32 from a solution in methyl ethyl ketone.

The adhesive layer, which is approximately 2 μm thick, is formed of a water-dispersible styrene acrylic polymer (Joncryl 138 sold by S.C. Johnson & Son, Inc., Racine, Wis. 53403) and is coated on to the ultraviolet filter layer 30 from an aqueous dispersion.

After the layers 30 and 28 have been coated on to the bubble-suppressant layer 32, the entire structure containing these three layers is laminated under heat (approximately 225° F., 107° C.) and pressure to the structure containing the layers 12–26 to form the complete imaging medium 10.

If desired, the bubble-suppressant layer 32 may be formed by coating, rather than by lamination of a preformed film on to the layers 12–26. If the bubble-suppressant layer 32 is to be formed by coating, it is convenient to incorporate an ultra-violet absorber into the bubble-suppressant layer, thereby avoiding the need for a separate ultra-violet absorber layer. Thus, in this case, the layer 28 is coated on to the layer 26 using the solvent already described, and then the bubble-suppressant layer 32 containing the ultra-violet absorber may be coated on to the layer 28 from an aqueous medium.

The medium 10 is imaged by exposing it to the beams from three infra-red lasers having wavelengths of approximately 792, 848 and 926 nm. The 926 nm beam images the yellow imaging layer 16, the 848 nm beam images the magenta imaging layer 22 and the 792 nm beam images the cyan imaging layer 26. Thus, a multicolor image is formed in the imaging medium 10, and this multicolor image requires no further development steps. Furthermore, the medium 10 may be handled in normal room lighting prior to exposure, and the apparatus in which the imaging is performed need not be light-tight.

The following Examples are given, though by way of illustration only, to show the effects of quinones and hydroquinones in increasing the sensitivity of the imaging medium of the present invention, and in reducing projector fading in images produced therefrom. The infra-red dyes used in combination with the leuco dyes of these Examples were different from those used in the preferred imaging medium described above with reference to FIG. 1, and were as follows:

With magenta leuco dyes:

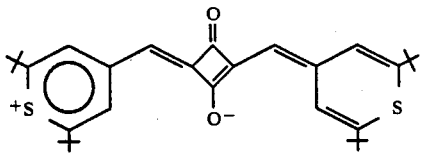

(VI)

see U.S. Pat. No. 4,508,811; and
With cyan leuco dyes:

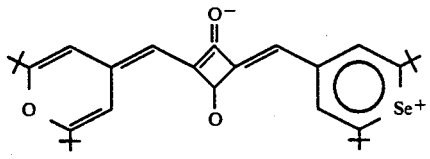

(VII)

which may be prepared as described in the aforementioned copending U.S. application Ser. No. 07/696,222.

EXAMPLE b 1

This Example illustrates the effect of chlorohydroquinone in increasing sensitivity of, and reducing projector fading of images formed from, imaging media containing the cyan leuco dye of Formula IV above.

Part A: Sensitivity Experiments

The following experiments used a simplified, monochrome model of the imaging medium described above with reference to FIG. 1. This simplified model comprised the support 12 incorporating an ultra-violet absorber, the cyan imaging layer 26 (with varying amounts of chlorohydroquinone, as described below, with the aforementioned Elvacite 2021 poly(methyl methacrylate) replacing the Estane 5715 used in the medium shown in FIG. 1, and with the infra-red absorber being that of Formula VII above), an adhesive layer 28 and a bubble-suppressant layer 32, which was formed from the same polymeric film as the support 12 and thus incorporated an ultra-violet absorber.

Three imaging media were prepared, a control in which the imaging layer contained no chlorohydroquinone, and two others in which the molar ratio of leuco dye to chlorohydroquinone was 1:0.5 and 1:1 (hereinafter referred to as "CHQ/LC=0.5" and "CHQ/LC=1" respectively). All three media were then imaged with a 792 nm laser at varying writing speeds (the speed at which the focussed spot from the laser is moved across the medium), a separate area of the medium being imaged at each writing speed, to produce images having regions of varying red optical densities. The red optical densities of the various areas of the resultant images were measured using an X-Rite 310 photographic densitometer (supplied by X-Rite, Inc., Grandville, Mich.) with the appropriate filter. The results are shown in Table 1 below and plotted in FIG. 2 of the accompanying drawings, in which the red optical density achieved is plotted against writing speed.

Part B: Projector Fading Experiments

The images produced in Part A above were placed in a Kodak Ektagraphic Model AF-2 slide projector (equipped with a Sylvania tungsten-halogen ELH 300 W 120 V bulb) for 10 minutes with the projector on the high setting, and the red optical densities of the various areas of the images remeasured following projector exposure in the same manner as before. The results are shown in Table i below and plotted in FIG. 3 of the accompanying drawings, in which the percentage change in red optical density of the images is plotted against the initial red optical density. This percentage change in optical density is calculated by:

$$\% \text{ Change in } O.D. = 100(D_a - D_b)/D_b$$

where $D_a$ is the optical density after projector exposure and $D_b$ is the optical density before exposure. Obviously, negative percentage changes in optical density represent fading of the image.

TABLE 1

| | Control | | CHQ/LC = 0.5 | | CHQ/LC = 1.0 | |
|---|---|---|---|---|---|---|
| Writing Speed, m/s | Initial Red Density | Change in O.D., % | Initial Red Density | Change in O.D., % | Initial Red Density | Change in O.D., % |
| 0.18 | 3.49 | 0.0 | 3.84 | −1.3 | 3.44 | 0.3 |
| 0.26 | 2.80 | −2.0 | 3.76 | −0.5 | 3.42 | 0.1 |
| 0.32 | 1.73 | −16.8 | 2.37 | 1.3 | 1.93 | −1.3 |
| 0.42 | 0.49 | −24.0 | 0.72 | −0.9 | 0.76 | 0.8 |
| 0.51 | 0.19 | −17.2 | 0.28 | 0.0 | 0.28 | 1.0 |

Figure 2:
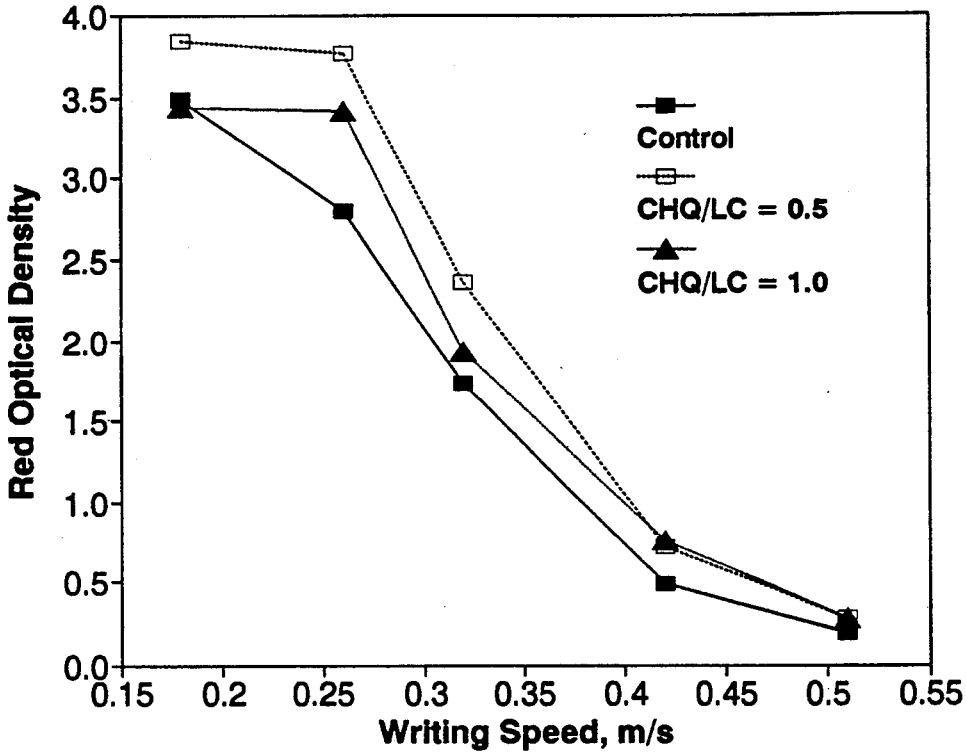
FIG. 2 shows the effect of chlorohydroquinone in increasing the sensitivity of a thermal imaging medium containing a cyan color-forming compound, as described in Example 1 below.

From Table 1 and FIG. 2 it will be seen that both hydroquinone-containing media produced optical densities at a given writing speed higher than that produced by the hydroquinone-free control medium, with the medium having a leuco dye:hydroquinone ratio of 1:1.0 usually giving a lower optical density at a given writing speed than the medium having a leuco dye:hydroquinone ratio of 1:0.5. Thus, the addition of hydroquinone to the cyan imaging layer rendered the medium more sensitive.

Quantifying the increase in sensitivity produced by a given hydroquinone or quinone additive is complicated by a "burn-out" phenomenon which is just visible in FIG. 2 but which is more easily discerned in other experiments described below; see, for example, FIG. 9. Although this "burn-out" phenomenon is not described in the aforementioned patents, it is known that if a thermal imaging medium having a color-forming layer such as those used in the present invention is imaged at progressively greater exposures (i.e., greater energy inputs per unit area of medium), the optical density of the image increases steadily with exposure until a point of maximum optical density is reached, after which further increase in exposure results in the optical density decreasing with exposure, so that very heavily exposed samples of medium have optical densities significantly less than the maximum achievable for that medium. It is this decrease in optical density with increasing exposure which is referred to as "burn-out". In experiments such as those whose results are shown in FIG. 2, in which a laser of constant energy output is used and the writing speed is varied, burn-out is manifested as a positive slope of the optical density against writing speed curve at low writing speeds, since exposure is inversely proportional to writing speed.

As might be expected, the experiments described herein show that media sensitized with hydroquinones or quinones in accordance with the present invention begin to manifest burn-out at lower exposures (and thus higher writing speeds) than similar unsensitized media. Accordingly, at low writing speeds a sensitized medium might produce a lower optical density than the corresponding unsensitized medium because at that low writing speed the sensitized medium is already suffering from severe burn-out, while the unsensitized medium has not begun to suffer from burn-out. Thus, the sensitivities of various media can only properly be compared at exposures and writing speeds where none of the media being compared are suffering from burn-out; in other words, when making sensitivity comparisons, the comparisons must be made in regions of optical density/writing speed curves where all the relevant curves have a significant negative slope. Hereinafter, quoted percentage increases in sensitivity are expressed as:

[{Average of (Optical Density of Sensitized Medium-/Optical Density of Unsensitized Medium)}−1]×100% with the relevant range of writing speeds indicated in parentheses following the percentage.

Using this formula, the CHQ/LC=0.5 medium showed a 42% (writing speeds 0.26–0.51 m/s) increase in sensitivity, and the CHQ/LC=1.0 medium showed a 34% (writing speeds 0.26–0.51 m/s) increase in sensitivity.

Figure 3:
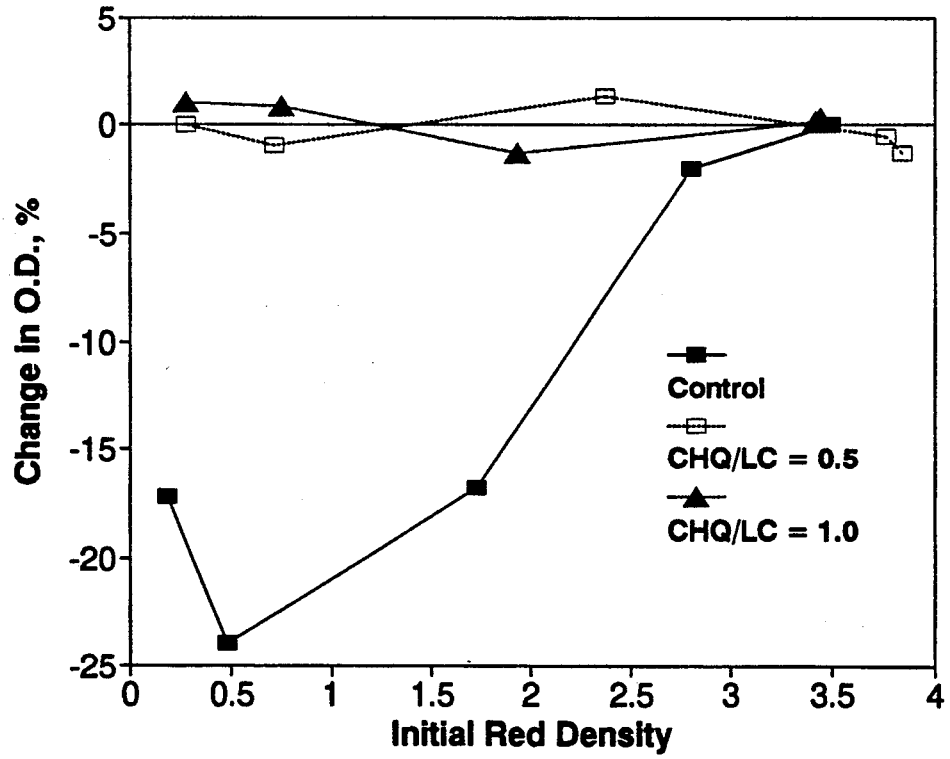
FIG. 3 shows the effect of chlorohydroquinone in preventing fading of images produced from a cyan color-forming compound, as described in Example 1 below.

Also, from Table 1 and FIG. 3 it will be seen that, in both hydroquinone-containing media, the fading experienced in the control medium after 10 minutes of projector exposure was substantially eliminated.

EXAMPLE 2

This Example illustrates the effect of 2-methyl-5-phenylhydroquinone ("MPHQ") in increasing sensitivity of, and reducing projector fading of images formed from, imaging media containing the cyan leuco dye of Formula IV above.

Example 1 was repeated, except that the chlorohydroquinone used in that Example was replaced with equimolar amounts of 2-methyl-5-phenylhydroquinone. The media were imaged and exposed in a projector in the same way as in Example 1. The results are given in Table 2 below; the results of the imaging experiments are plotted in FIG. 4, while the result of the projector experiments are plotted in FIG. 5 below.

TABLE 2

| | Control | | MPHQ/LC = 0.5 | | MPHQ/LC = 1.0 | |
|---|---|---|---|---|---|---|
| Writing Speed, m/s | Initial Red Density | Change in O.D., % | Initial Red Density | Change in O.D., % | Initial Red Density | Change in O.D., % |
| 0.18 | 3.49 | 0.0 | 3.64 | 2.2 | 4.05 | −2.5 |
| 0.26 | 2.80 | −2.0 | 3.42 | 1.9 | 3.24 | 0.0 |
| 0.32 | 1.73 | −16.8 | 1.81 | 0.0 | 1.70 | −5.9 |
| 0.42 | 0.49 | −24.0 | 0.53 | −2.0 | 0.45 | −1.8 |
| 0.51 | 0.19 | −17.2 | 0.21 | −2.9 | 0.17 | 7.2 |

From Table 2 and FIG. 4 it will be seen that both hydroquinone-containing media produced some increase in optical densities at low writing speeds, although the improvement was smaller than for the chlorohydroquinone-containing media in Example 1 above; the medium having a leuco dye:hydroquinone ratio of 1:0.5 showed an average increase in sensitivity of about 12% (writing speeds 0.26–0.51 m/s), whereas the medium having a leuco dye:hydroquinone ratio of 1:1.0 showed a smaller increase in sensitivity.

Figure 5:
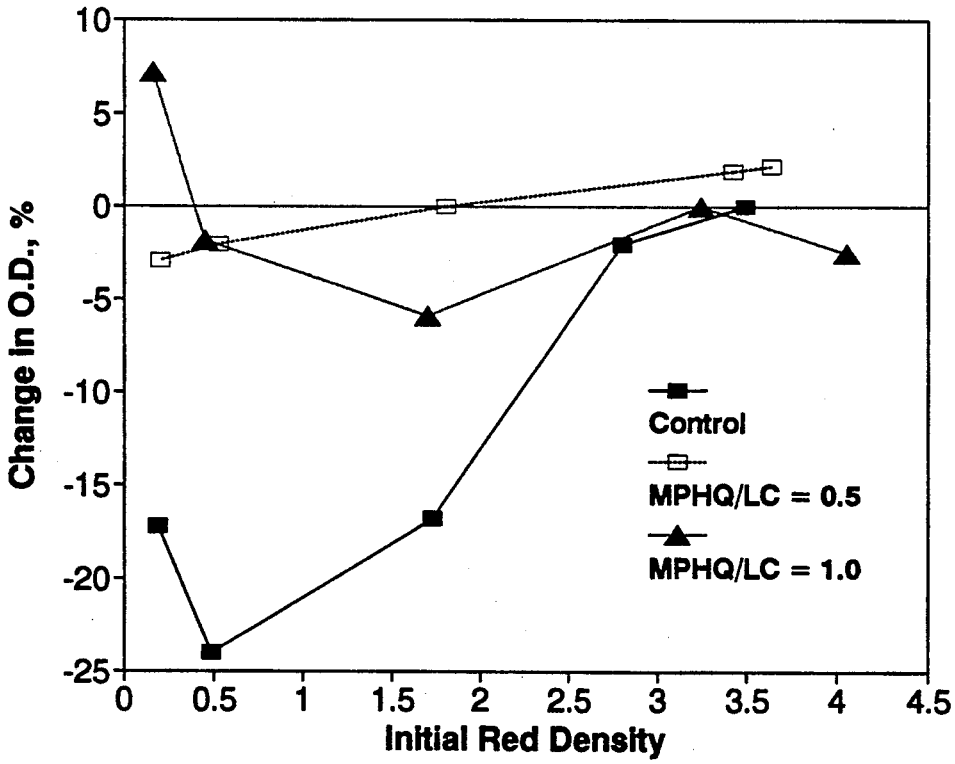
FIG. 5 shows the effect of 2-methyl-5-phenylhydroquinone in preventing fading of images produced from a cyan color-forming compound, as described in Example 2 below.

Also, from Table 2 and FIG. 5 it will be seen that, in both hydroquinone-containing media, the fading experienced in the control medium after 10 minutes of projector exposure was substantially reduced, and in the case of the medium having a leuco dye:hydroquinone ratio of 1:0.5, substantially eliminated.

EXAMPLE 3

This Example illustrates the effect of varying amounts of 2-methyl-5-phenylhydroquinone in reducing projector fading of images formed from imaging media containing the cyan leuco dye of Formula IV above.

Example 2 was repeated, except that the media used were a control medium free from hydroquinone and media in which the imaging layer contained MPHQ at leuco cyan dye:MPHQ molar ratios of 1:0.14, 1:0.28, 1:0.37 and 1:0.49. The media were imaged at writing speeds of 0.18, 0.22, 0.26, 0.32, 0.42 and 0.51 m/s, and exposed in a projector in the same way as in Examples 1 and 2. The results are given in Table 3 below and plotted in FIG. 6.

TABLE 3

| Control | | MPHQ/LC = 0.14 | | MPHQ/LC = 0.28 | | MPHQ/LC = 0.37 | | MPHQ/LC = 0.49 | |
|---|---|---|---|---|---|---|---|---|---|
| Initial Red Density | Change in O.D., % | Initial Red Density | Change in O.D., % | Initial Red Density | Change in O.D., % | Initial Red Density | Change in O.D., % | Initial Red Density | Change in O.D., % |
| 3.76 | −8.0 | 3.83 | −1.7 | 3.85 | −4.9 | 4.67 | −4.9 | 4.16 | 0.6 |
| 2.79 | −10.4 | 3.78 | −6.9 | 3.73 | −1.2 | 4.33 | −1.2 | 4.00 | −0.6 |
| 2.67 | −7.9 | 3.15 | −5.1 | 3.02 | −2.6 | 3.31 | −6.0 | 3.44 | 0.3 |
| 1.70 | −24.0 | 1.68 | −14.0 | 1.56 | −7.1 | 1.58 | −8.9 | 1.76 | −3.4 |
| 0.42 | −30.0 | 0.48 | −12.3 | 0.51 | −15.6 | 0.37 | −12.9 | 0.48 | −6.7 |
| 0.13 | −12.0 | 0.21 | −14.4 | 0.19 | −8.8 | 0.16 | −10.3 | 0.20 | −8.2 |

Figure 6:
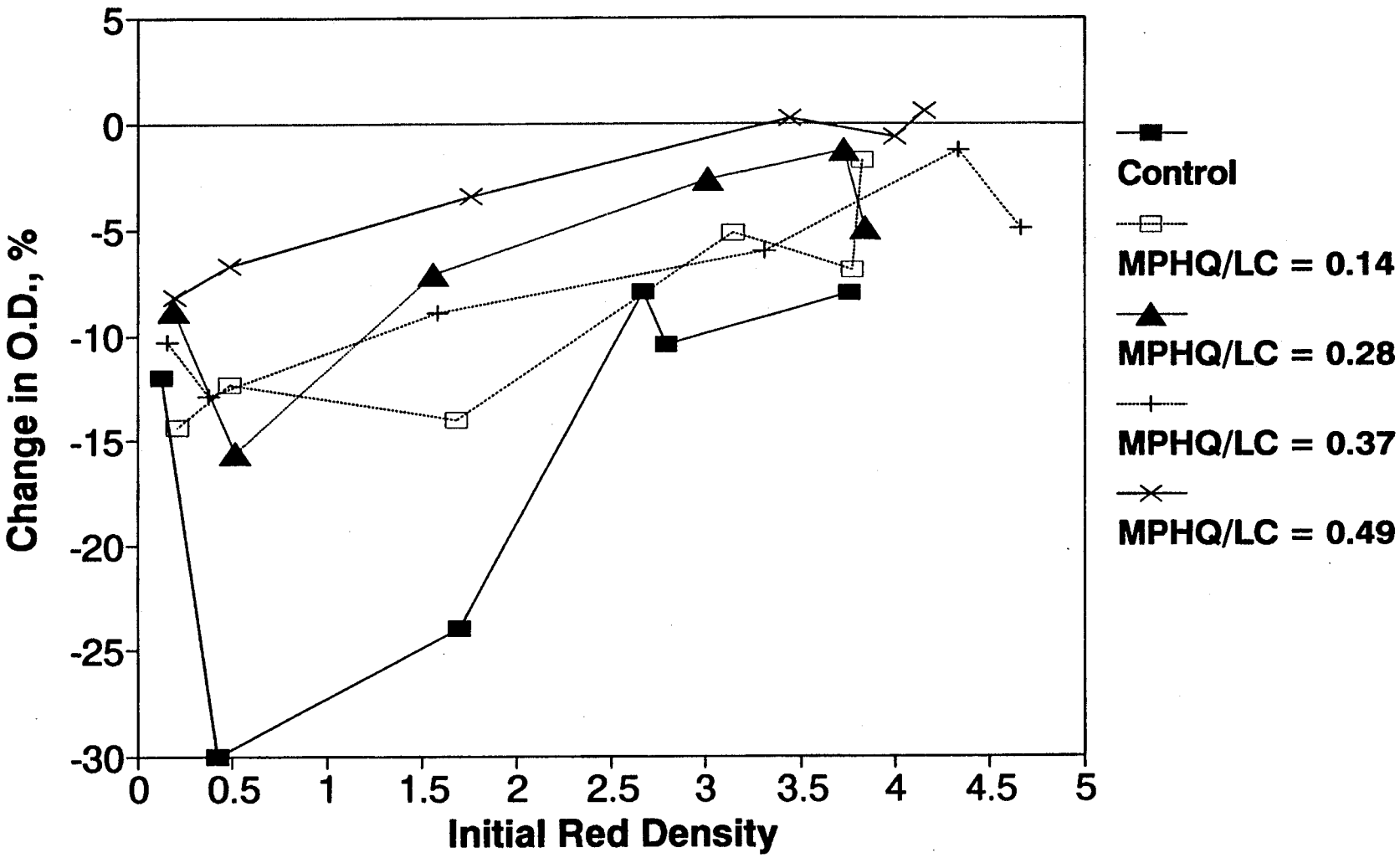
FIG. 6 shows the effect of various concentrations of 2-methyl-5-phenylhydroquinone in preventing fading of images produced from a cyan color-forming compound, as described in Example 3 below.

From Table 3 and FIG. 6, it will be seen that all the MPHQ-containing media showed less fading than the control medium, with the LC:MPHQ=1:0.49 medium exhibiting the smallest average fading.

EXAMPLE 4

This Example illustrates the effect of varying amounts of 2,5-di-t-butylhydroquinone ("DtBHQ") in reducing projector fading of images formed from imaging media containing the cyan leuco dye of Formula IV above.

Example 3 was repeated, except that the media used were a control medium free from hydroquinone and media in which the imaging layer contained DtBHQ at leuco cyan dye:DtBHQ molar ratios of 1:0.24, 1:0.48, 1:0.71 and 1:0.84. The media were imaged at writing speeds of 0.18, 0.22, 0.26, 0.32, 0.42 and 0.51 m/s, and exposed in a protector in the same way as in Examples 1 to 3. The results are given in Table 4 below and plotted in FIG. 7.

TABLE 4

| Control | | DtBHQ/LC = 0.24 | | DtBHQ/LC = 0.48 | | DtBHQ/LC = 0.71 | | DtBHQ/LC = 0.84 | |
|---|---|---|---|---|---|---|---|---|---|
| Initial Red Density | Change in O.D., % | Initial Red Density | Change in O.D., % | Initial Red Density | Change in O.D., % | Initial Red Density | Change in O.D., % | Initial Red Density | Change in O.D., % |
| 2.85 | −8.1 | 2.81 | 2.5 | 2.70 | −6.3 | 2.39 | 1.7 | 3.27 | −4.3 |
| 2.48 | −7.7 | 2.29 | −6.6 | 2.03 | −8.9 | 1.84 | −1.6 | 3.06 | −0.7 |
| 1.87 | −16.0 | 1.38 | −16.7 | 1.39 | −12.9 | 1.10 | −10.1 | 1.97 | −2.5 |
| 0.99 | −22.0 | 0.61 | −20.3 | 0.77 | −16.9 | 0.55 | −18.2 | 0.88 | −1.8 |
| 0.30 | −15.6 | 0.17 | −17.6 | 0.25 | −20.0 | 0.14 | −14.2 | 0.23 | −4.3 |
| 0.12 | −8.5 | 0.08 | −5.0 | 0.11 | −9.5 | | | | |

Figure 7:
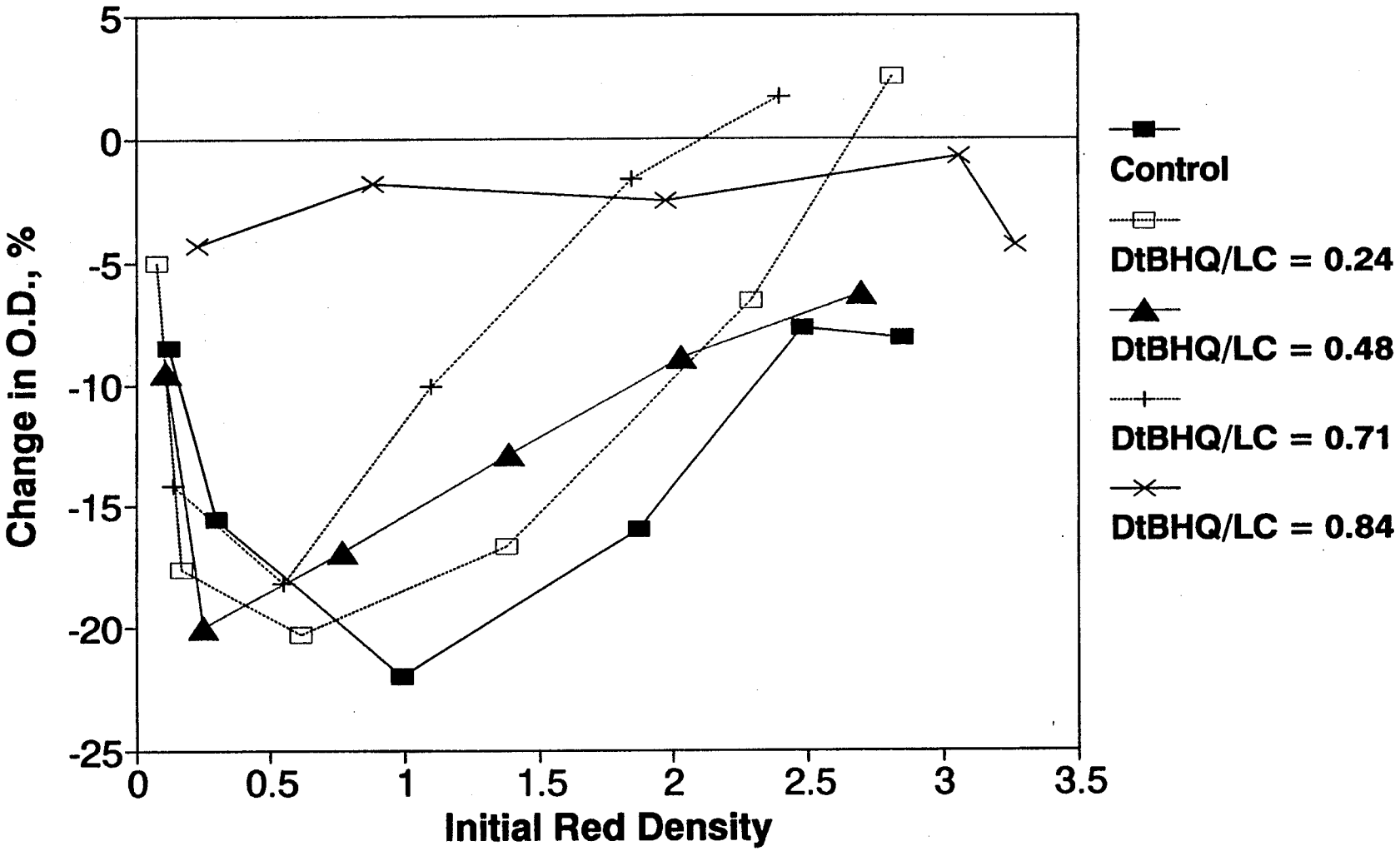
FIG. 7 shows the effect of various concentrations of 2,5-di-t-butylhydroquinone in preventing fading of images produced from a cyan color-forming compound, as described in Example 4 below.

From Table 4 and FIG. 7, it will be seen that all the DtBHQ-containing media showed less fading than the control medium, with the LC:DtBHQ=1:0.84 medium exhibiting the smallest average fading. By comparing Table 4 with Table 3 and FIG. 7 with FIG. 6, it will be seen, however, that DtBHQ appears to be less effective than MPHQ in reducing fading of this leuco cyan dye; the medium with DtBHQ/LC=0.84 showed about the same fading as the medium with MPHQ/LC=0.49.

EXAMPLE 5

This Example illustrates the effect of 2,5-di-t-butylhydroquinone in reducing projector fading of images formed from imaging media containing the magenta leuco dye of Formula III above.

Example 4 was repeated, except that the cyan imaging layer was replaced with a magenta imaging layer similar to the magenta imaging layer 22 described above with reference to FIG. 1 but containing the infra-red dye of Formula VI above. Only two media were used, namely a control medium free from hydroquinone and a medium in which the imaging layer contained DtBHQ at a leuco magenta dye:DtBHQ molar ratio of 1:0.76. The media were imaged at writing speeds of 0.18, 0.22, 0.26, 0.32, 0.42, 0.51 and 0.63 m/s, and exposed in a projector in the same way as in Examples 1 to 4, but for a period of 20 minutes. The results are given in Table 5 below and plotted in FIG. 8; for obvious reasons, green rather than red optical densities were measured for the magenta dye images.

TABLE 5

| Control | | DtBHQ/LM = 0.76 | |
|---|---|---|---|
| Initial Green Density | Change in O.D., % | Initial Green Density | Change in O.D., % |
| 3.22 | −3.7 | 3.18 | 5.0 |
| 3.19 | −2.5 | 3.15 | 3.2 |
| 2.98 | −7.0 | 3.04 | 2.0 |
| 1.96 | −9.2 | 2.09 | 1.0 |
| 0.67 | −12.0 | 0.67 | −3.0 |
| 0.22 | −18 | 0.24 | −8.4 |

Figure 8:
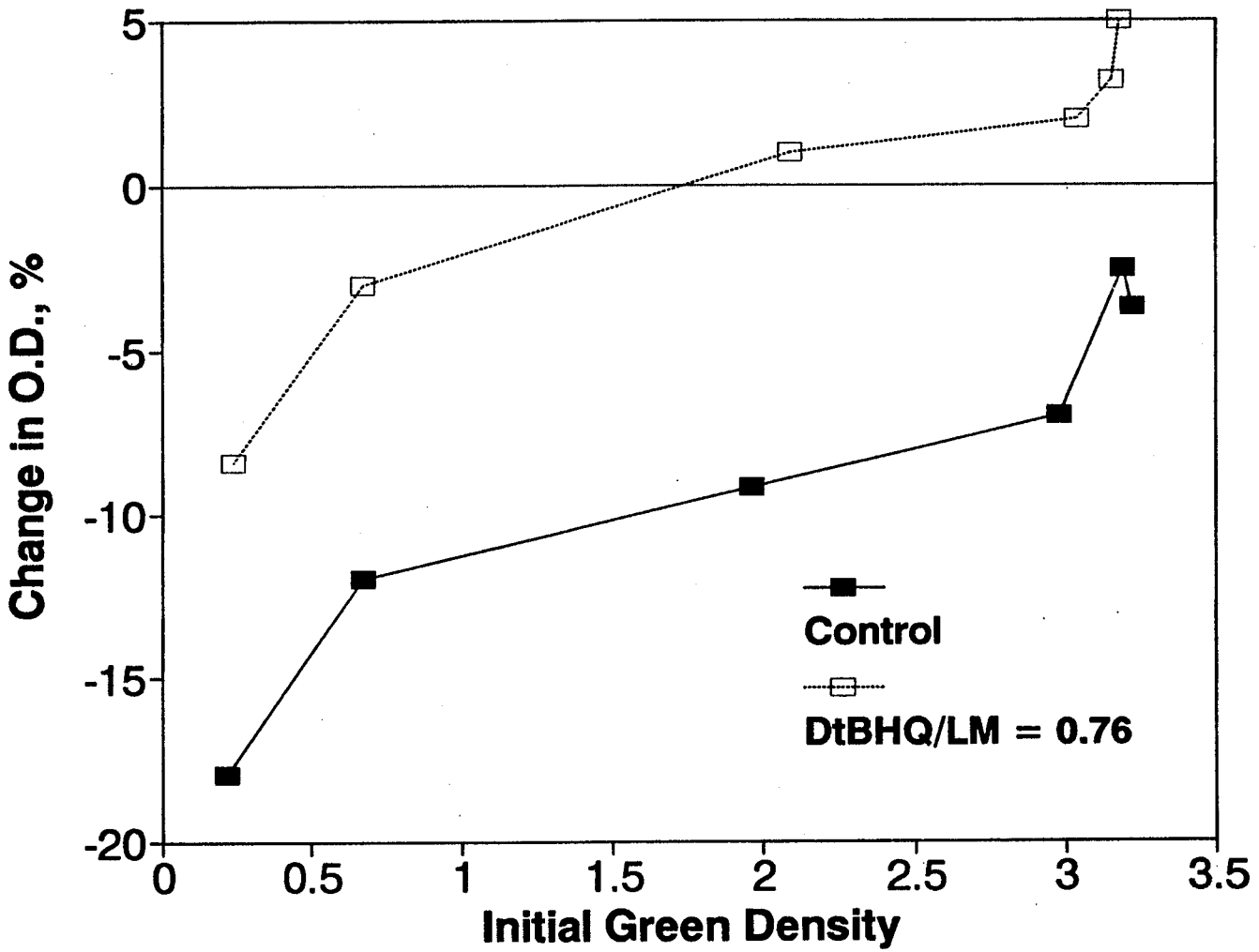
FIG. 8 shows the effect of 2,5-di-t-butylhydroquinone in preventing fading of images produced from a magenta color-forming compound, as described in Example 5 below.

From Table 5 and FIG. 8, it Will be seen that the addition of the DtBHQ to the magenta imaging layer greatly reduced the projector fading of the images produced from that imaging layer.

EXAMPLE 6

This Example illustrates the effect of catechol and resorcinol in increasing sensitivity of, and reducing projector fading of images formed from, imaging media containing the cyan leuco dye of Formula IV above.

Example 1 was repeated, except that the media used were the control medium, a medium containing catechol at a leuco dye:catechol molar ratio of 1:1.08, and a medium containing resorcinol at a leuco dye:resorcinol molar ratio of 1:1.05. The infra-red optical densities of the three media at 792 nm were found to be 0.89, 1.09 and 1.05 respectively. The media were imaged and exposed in a projector in the same way as in Example 1. The results are given in Table 6 below; the results of the imaging experiments are plotted in FIG. 9, while the result of the projector experiments are plotted in FIG. 10 below.

TABLE 6

| | Control | | Catechol/LC = 1.08 | | Resorcinol/LC = 1.05 | |
|---|---|---|---|---|---|---|
| Writing Speed, m/s | Initial Red Density | Change in O.D., % | Initial Red Density | Change in O.D., % | Initial Red Density | Change in O.D., % |
| 0.125 | 2.55 | −9.1 | 2.80 | −1.8 | 2.81 | −2.1 |
| 0.140 | 2.46 | −13.3 | 2.89 | −0.7 | 2.85 | −0.4 |
| 0.160 | 2.15 | −12.6 | 2.83 | −2.5 | 2.70 | −0.7 |
| 0.180 | 1.66 | −13.3 | 2.53 | −3.2 | 2.30 | −4.3 |
| 0.220 | 1.10 | −15.4 | 1.80 | −2.2 | 1.55 | −3.9 |
| 0.260 | 0.55 | −7.8 | 0.97 | −2.6 | 0.84 | −4.8 |
| 0.320 | 0.24 | −4.2 | 0.39 | −2.1 | 0.35 | −2.9 |

Figure 9:
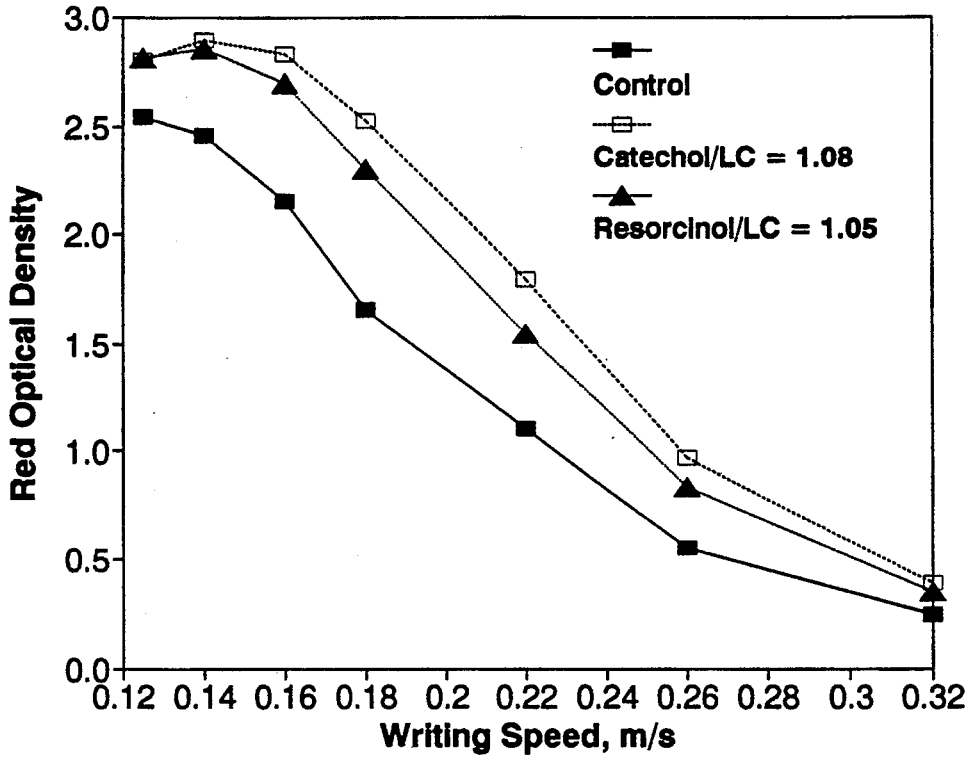
FIG. 9 shows the effects of catechol and resorcinol in increasing the sensitivity of a thermal imaging medium containing a cyan color-forming compound, as described in Example 6 below.

From Table 6 and FIG. 9 it will be seen that both hydroquinone-containing media produced significant improvements in sensitivity, especially when allowance is made for the burn-out phenomenon discussed above, which these media display at the 0.125 and 0.14 m/s writing speeds. The average increase in optical density for the catechol-containing medium was 57% (writing speeds 0.16–0.32 m/s), while the average increase in optical density for the resorcinol-containing medium was 41% (writing speeds 0.16–0.32 m/s). FIG. 9 shows catechol to be more effective as a sensitizer than resorcinol in these experiments.

Figure 10:
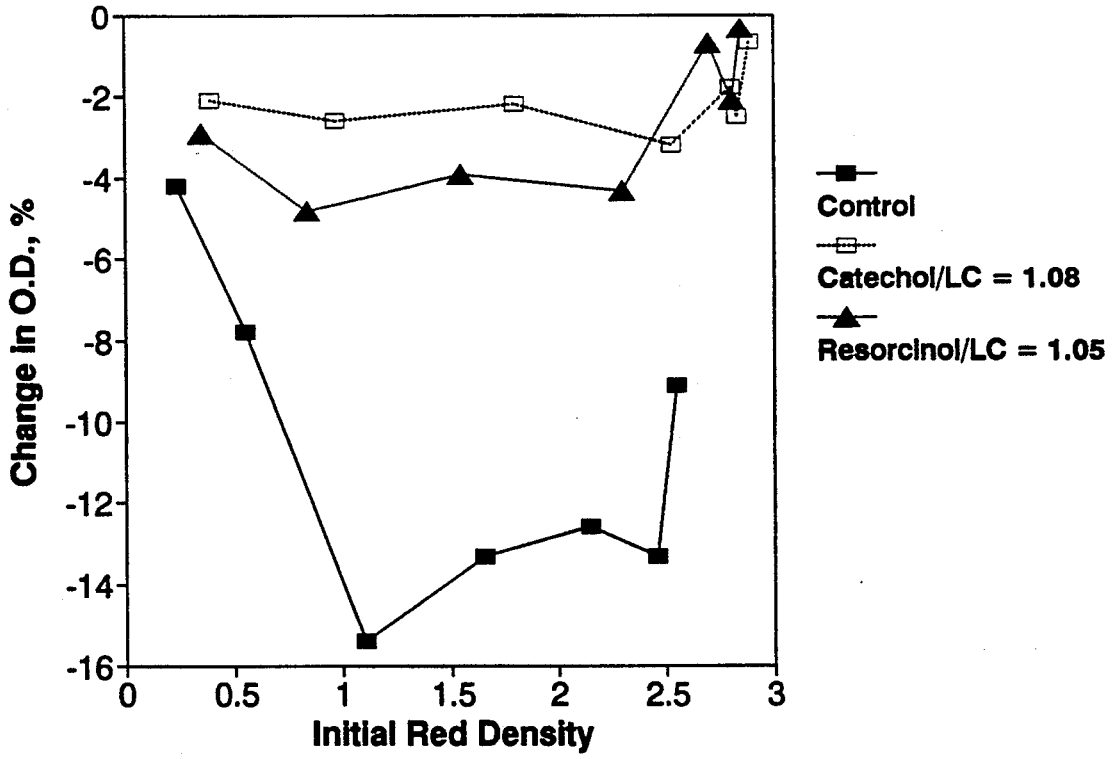
FIG. 10 shows the effect of catechol and resorcinol in preventing fading of images produced from a cyan color-forming compound, as described in Example 6 below.

Also, from Table 6 and FIG. 10 it will be seen that, in both hydroquinone-containing media, the fading experienced in the control medium after 10 minutes of projector exposure was very substantially reduced.

EXAMPLE 7

This Example illustrates the effect of 2-phenyl-5-t-butylhydroquinone ("PtBHQ"), phenylhydroquinone ("PHQ") and 2,5-dichlorohydroquinone ("DClHQ") in increasing sensitivity of, and reducing projector fading of images formed from, imaging media containing the cyan leuco dye of Formula IV above.

Example 1 was repeated, except that the media used were the control medium and three media in which the cyan imaging layer contained respectively PtBHQ, PHQ and DClHQ, each at a leuco dye:hydroquinone molar ratio of 1:0.5. The media were imaged and exposed in a projector in the same way as in Example 1. The results are given in Table 7 below; the results of the imaging experiments are plotted in FIG. 11, while the results of the projector experiments are plotted in FIG. 12 below.

TABLE 7

| | Control | | PtBHQ/LC = 0.5 | | PHQ/LC = 0.5 | | DClHQ/LC = 0.5 | |
|---|---|---|---|---|---|---|---|---|
| Writing Speed, m/s | Initial Red Density | Change in O.D., % | Initial Red Density | Change in O.D., % | Initial Red Density | Change in O.D., % | Initial Red Density | Change in O.D., % |
| 0.18 | 2.75 | −6.5 | 3.53 | 0.0 | 3.19 | −0.9 | 3.36 | −1.2 |
| 0.22 | 2.71 | −9.6 | 3.25 | 4.0 | 3.21 | 2.2 | 3.38 | 1.8 |
| 0.26 | 2.28 | −12.7 | 2.66 | 1.9 | 2.75 | 1.8 | 3.18 | −2.5 |
| 0.32 | 1.44 | −18.1 | 1.46 | −3.4 | 1.55 | −1.3 | 2.03 | −3.4 |
| 0.42 | 0.55 | −18.2 | 0.37 | −5.0 | 0.43 | −4.7 | 0.66 | −3.0 |
| 0.51 | 0.22 | −22.7 | 0.17 | 0.0 | 0.19 | −10.5 | 0.25 | 0.0 |

Figure 11:
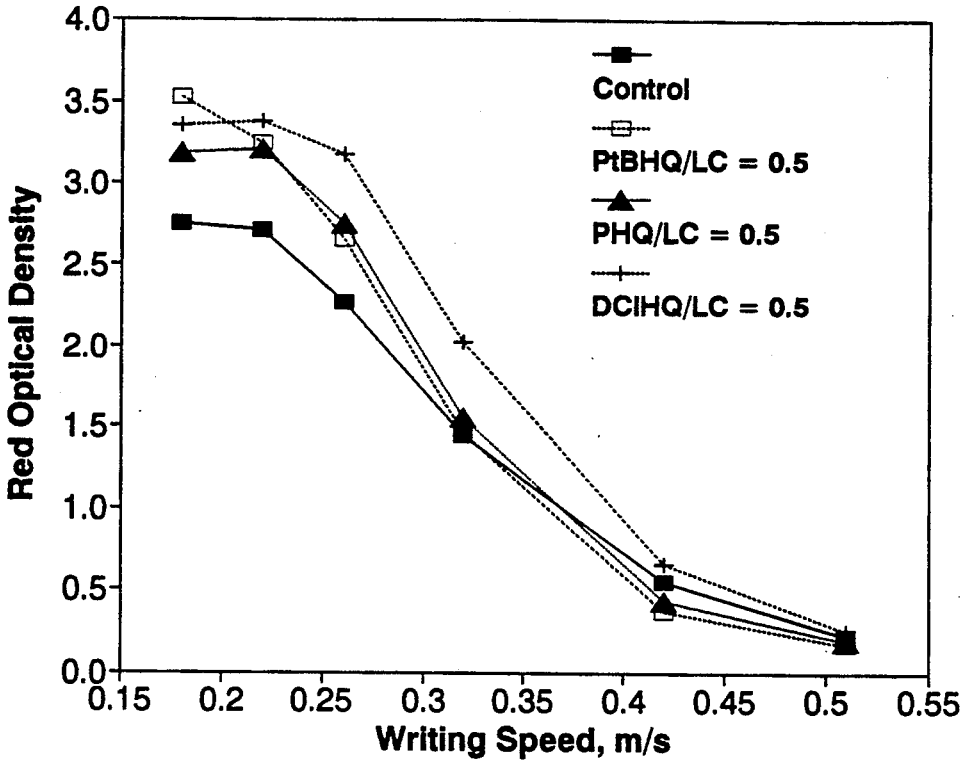
FIG. 11 shows the effects of 2-phenyl-5-t-butylhydroquinone, phenylhydroquinone and 2,5-dichlorohydroquinone in increasing the sensitivity of a thermal imaging medium containing a cyan color-forming compound, as described in Example 7 below.

From Table 7 and FIG. 11 it will be seen that all three hydroquinone-containing media produced significant improvements in sensitivity, especially when allowance is made for the burn-out phenomenon discussed above, which these media display at low writing speeds. FIG. 11 indicates that the order of effectiveness as sensitizers is:

DClHQ > PHQ > PtBHQ.

Figure 12:
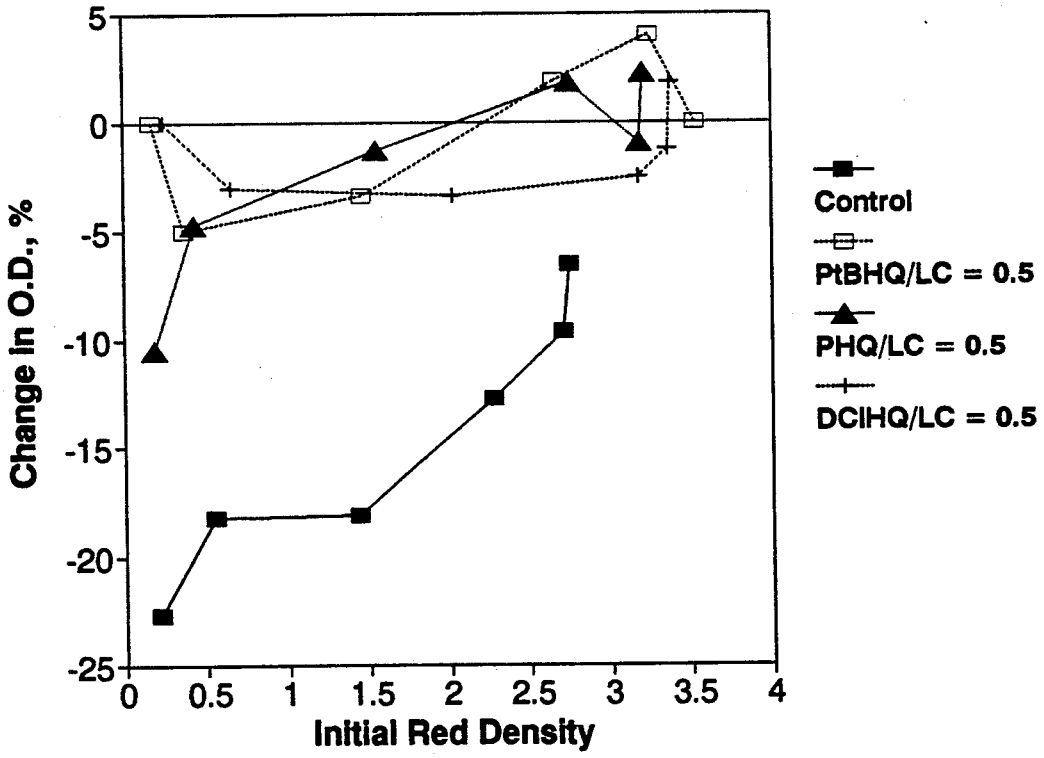
FIG. 12 shows the effects of 2-phenyl-5-t-butylhydroquinone, phenylhydroquinone and 2,5-dichlorohydroquinone in preventing fading of images produced from a cyan color-forming compound, as described in Example 7 below.

Also, from Table 7 and FIG. 12 it will be seen that, in all the three hydroquinone-containing media, the fading experienced in the control medium after 10 minutes of projector exposure was very substantially reduced.

EXAMPLE 8

This Example illustrates the effect of 2-methyl-5-phenylhydroquinone ("MPHQ"), phenylhydroquinone ("PHQ"), 2-phenyl-5-t-butylhydroquinone ("PtBHQ"), 2,5-di-t-butylhydroquinone ("DtBHQ") and 2,5-dichlorohydroquinone ("DClHQ") in reducing projector fading of images formed from imaging media containing the cyan leuco dye of Formula IV above.

Example 1 was repeated, except that the media used were a control medium free from hydroquinone and six media containing in which the cyan imaging layer contained respectively MPHQ, PHQ, PtBHQ, DtBHQ and DClHQ, each at a leuco cyan dye:hydroquinone molar ratio of 1:0.25. The media were imaged at writing speeds of 0.18, 0.22, 0.26, 0.32, 0.42 and 0.51 m/s, and exposed in a projector in the same way as in Examples 1 to 3. The results are given in Table 8 below and plotted in FIGS. 13 and 14 (the control results are shown in both Figures for ease of comparison).

TABLE 8

| Control | | MPHQ/LC = 0.25 | | PHQ/LC = 0.25 | | PtBHQ/LC = 0.25 | | DtBHQ/LC = 0.25 | | DClHQ/LC = 0.25 | |
|---|---|---|---|---|---|---|---|---|---|---|---|
| Initial Red Density | Change in O.D., % | Initial Red Density | Change in O.D., % | Initial Red Density | Change in O.D., % | Initial Red Density | Change in O.D., % | Initial Red Density | Change in O.D., % | Initial Red Density | Change in O.D., % |
| 3.42 | −9.4 | 3.77 | −2.9 | 3.94 | −3.3 | 3.88 | −1.6 | 3.37 | 1.5 | 3.67 | −2.7 |
| 3.15 | −12.7 | 3.62 | −2.2 | 3.69 | −6.5 | 3.80 | −1.6 | 3.34 | −2.1 | 3.26 | −1.5 |
| 3.01 | −28.4 | 3.18 | −2.8 | 3.43 | −2.0 | 3.04 | −7.7 | 2.61 | −3.4 | 2.66 | −2.3 |
| 1.67 | −35.4 | 1.74 | −11.5 | 1.90 | −6.3 | 1.59 | −19.5 | 1.37 | −15.3 | 1.77 | −9.0 |
| 0.44 | −37.6 | 0.48 | −17.5 | 0.58 | −17.2 | 0.46 | −30.4 | 0.42 | −26.2 | 0.61 | −7.5 |
| 0.18 | −13.5 | 0.19 | −9.1 | 0.25 | −16.3 | 0.19 | −21.1 | 0.20 | −25.0 | 0.24 | −8.3 |

Figure 13:
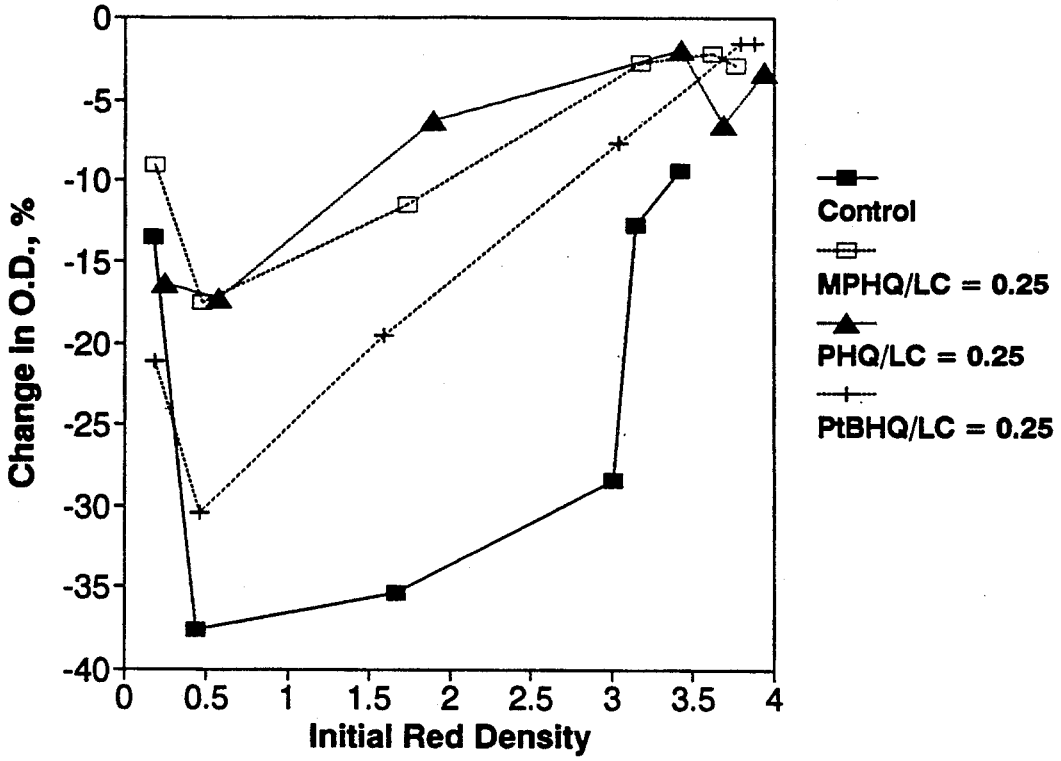
FIG. 13 shows the effects of 2-methyl-5-phenylhydroquinone, phenylhydroquinone and 2-phenyl-5-t-butylhydroquinone in preventing fading of images produced from a cyan color-forming compound, as described in Example 8 below.
Figure 14:
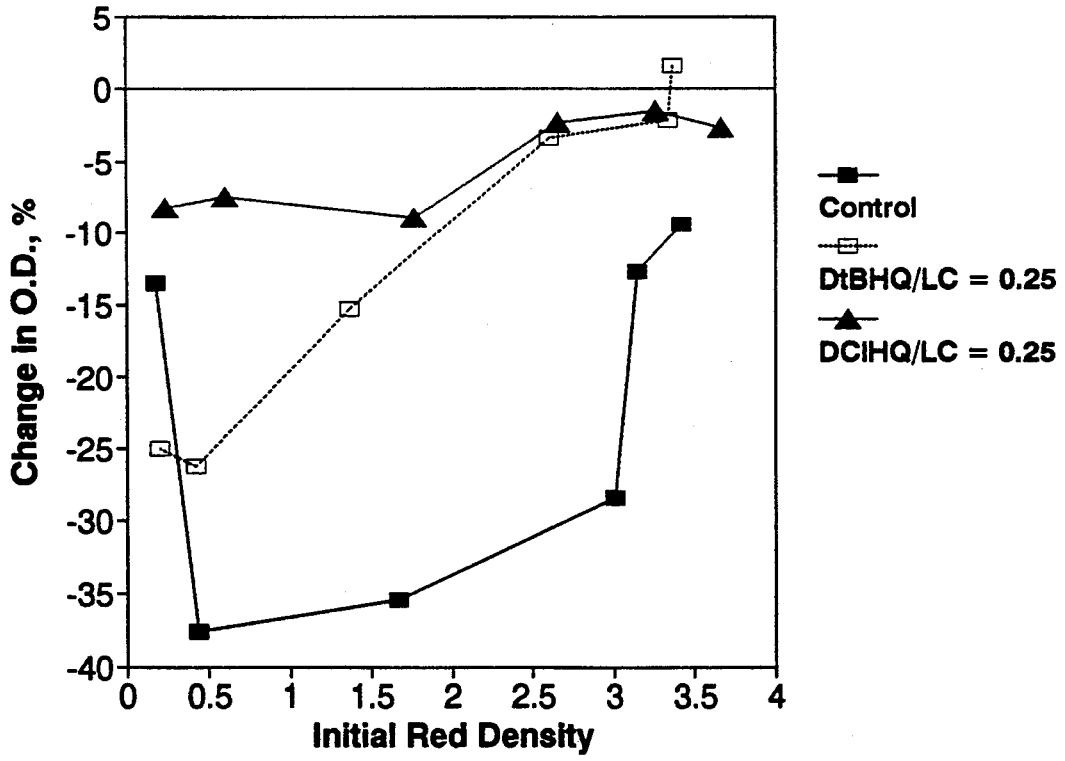
FIG. 14 shows the effects of 2,5-di-t-butylhydroquinone and 2,5-dichlorohydroquinone in preventing fading of images produced from a cyan color-forming compound, as described in Example 8 below.

From Table 8 and FIGS. 13 and 14, it will be seen that all of the hydroquinone-containing media showed significantly less fading than the control medium, with the MPHQ, PHQ and DClHQ-containing media showing greatly reduced fading. Based upon these results, the order of effectiveness of the hydroquinones in preventing fading appears to be:

DClHQ > PHQ ≈ MPHQ > DtBHQ ≈ PtBHQ.

EXAMPLE 9

This Example demonstrates that the addition of hydroquinones to imaging media in accordance with the present invention does not produce unacceptable increases in the minimum optical densities of the media.

Figure 15A:
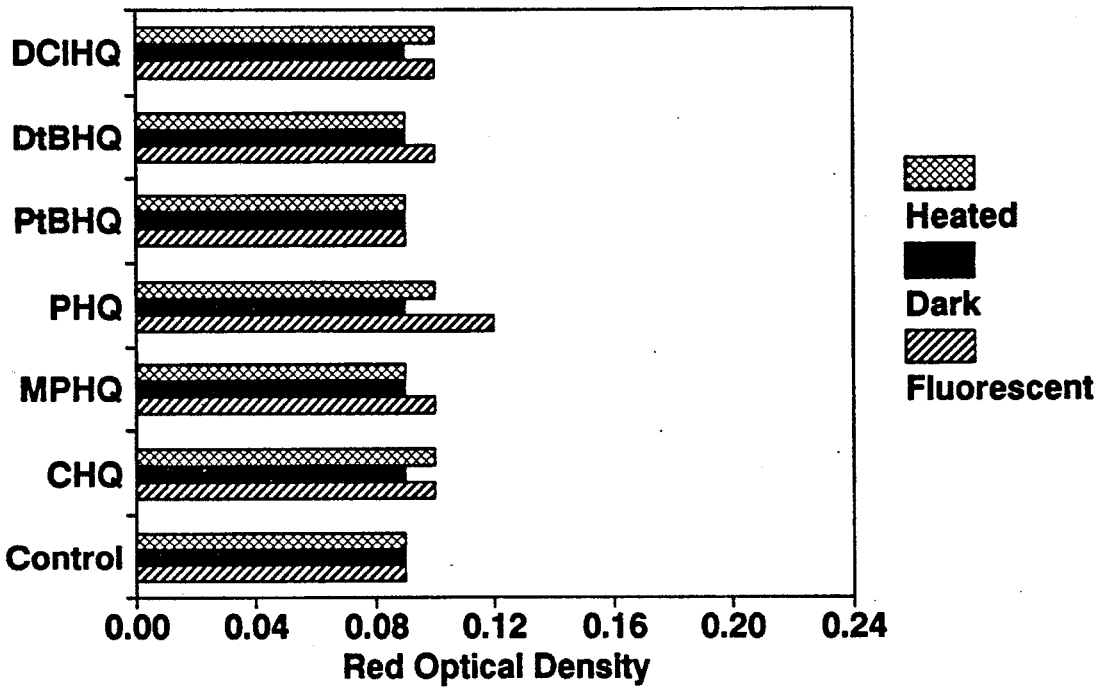
FIGS. 15A, 15B and 15C show the effects upon the red, green and blue minimum optical densities of a medium caused by addition of various hydroquinones, as described in Example 9 below.
Figure 15B:
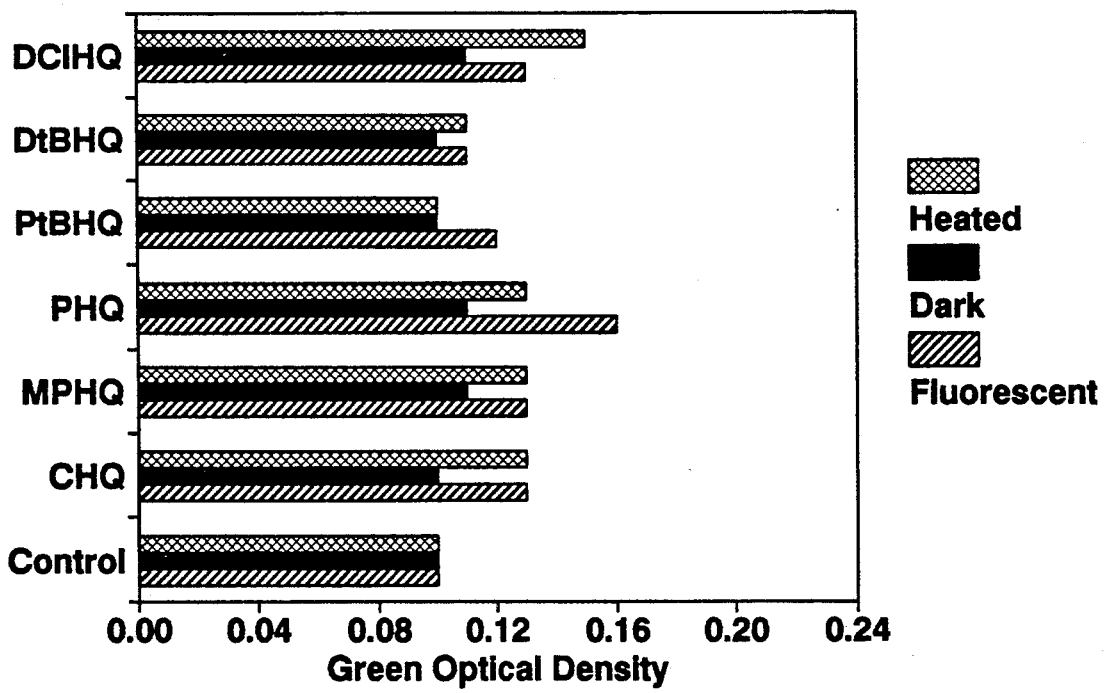
Figure 15C:
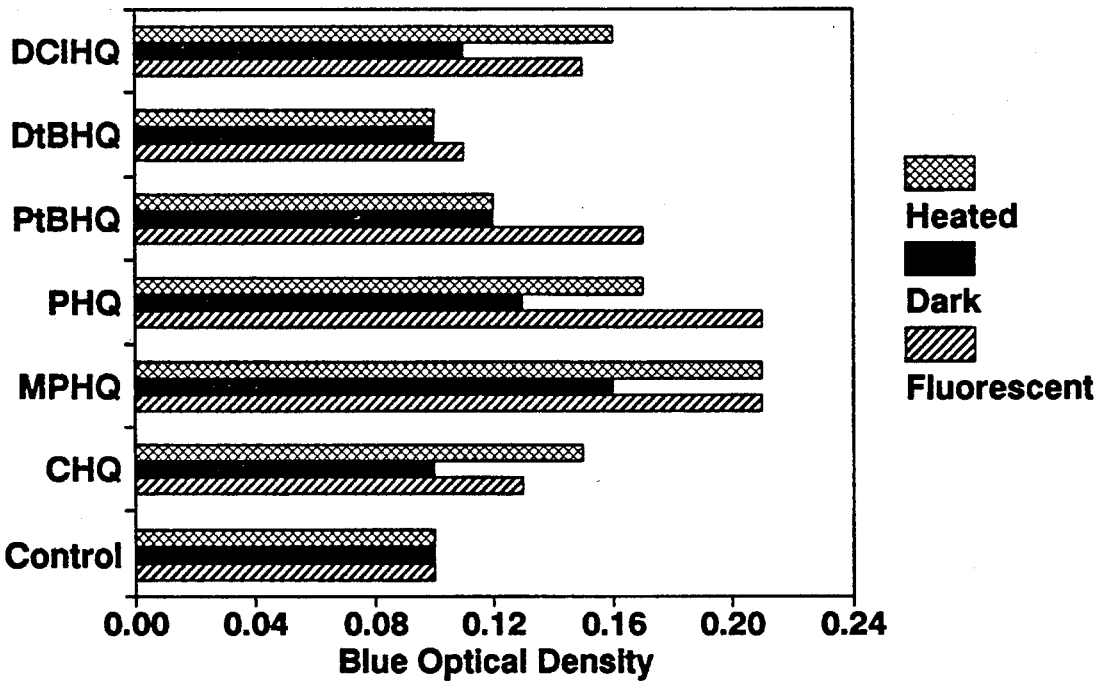

It is known that, when used in varying types of imaging media, hydroquinones sometimes cause staining problems because air oxidation of the hydroquinones leads to the formation of yellowish materials. To determine whether such staining problems were likely to be significant in imaging media of the present invention, 25 microliters of $2\times10^{-5}$M solutions (0.5 nanomoles) of various hydroquinones were deposited on silica gel plates, and three separate samples of the treated plates were stored for 18.5 hours at room temperature in the dark, at room temperature under intense fluorescent lighting (510 ft. candles, approximately ten times normal room lighting intensity), and in a 70° C. oven respectively. The red, green and blue optical densities of each sample of the silica gel plates were read over a white target using an X-Rite 310 photographic densitometer. The results are shown in FIGS. 15A, 15B and 15C of the accompanying drawings.

From these Figures it will be seen that, as would be expected, the major effect of adding the hydroquinones was an increase in the blue optical density of the medium, especially in the samples stored under intense light or at elevated temperature. Based upon these results, PtBHQ and DtBHQ are preferred for their lack of staining.

It should be noted that the conditions used in these experiments were deliberately made likely to produce staining, in that the hydroquinones were placed on a material with a large surface area freely exposed to atmospheric oxygen. Increases in minimum optical densities produced by the use of hydroquinones in thermal imaging media such as that described above with reference to FIG. 1, in which the hydroquinone-containing layers are sandwiched between two plastic films, are likely to be much less than those obtained in these experiments.

EXAMPLE 10

This Example illustrates the use of quinones in the present invention.

Figure 17:
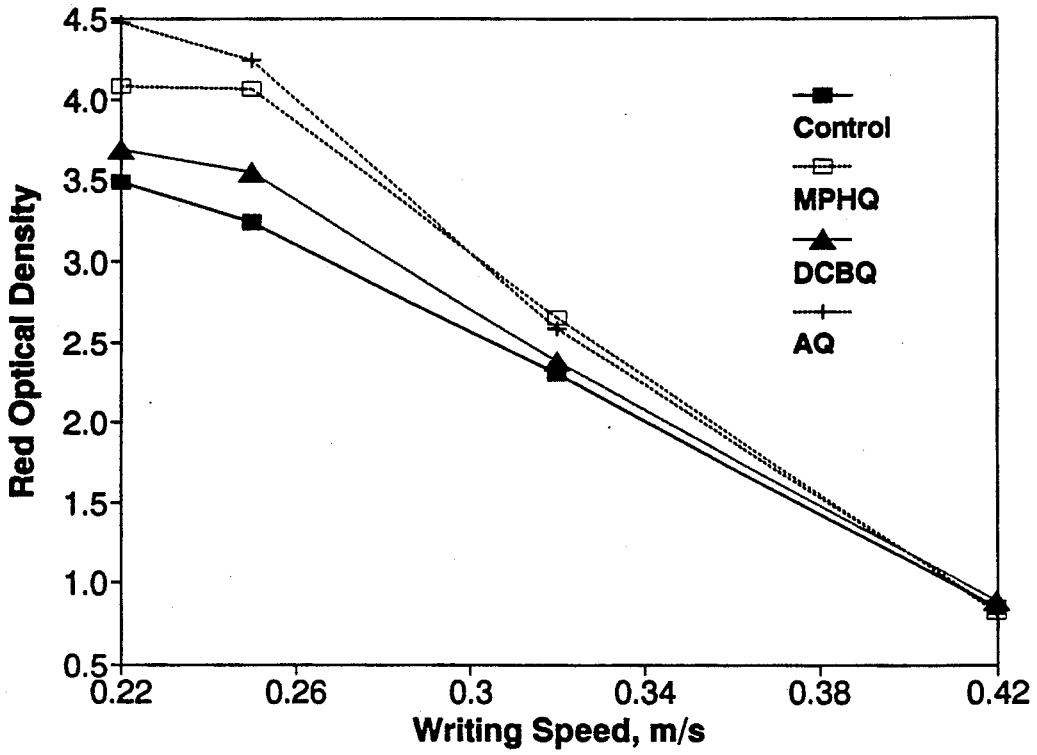
FIG. 17 shows the effects of 2-methyl-5-phenylhydroquinone, 2,6-dichloro-1,4-benzoquinone and 9,10-anthraquinone in increasing the sensitivity of a thermal imaging medium containing a cyan color-forming compound, as described in Example 10 below.
Figure 18:
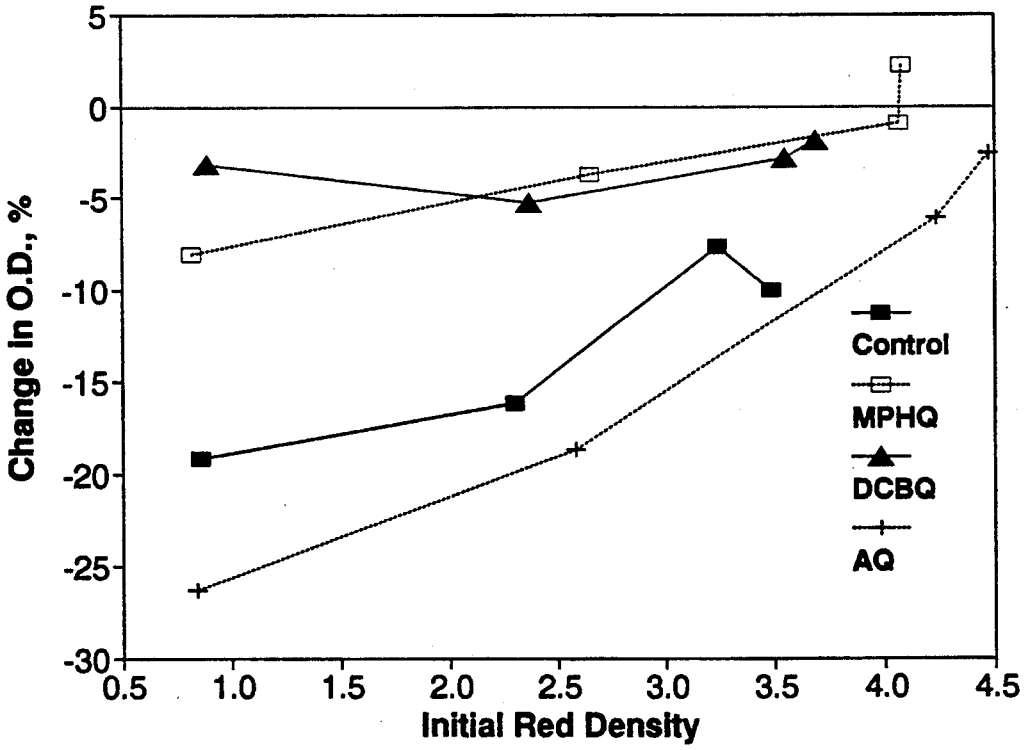
FIG. 18 shows the effect of 2-methyl-5-phenylhydroquinone, 2,6-dichloro-1,4-benzoquinone and 9,10-anthraquinone in preventing fading of images produced from a cyan color-forming compound, as described in Example 10 below.

The media used in these experiments were substantially similar to those used in Example 1 above. The infra-red dye (VII—0.36 g of a 1% w/v solution in 2-butanone), the cyan leuco dye (IV—0.22 g) and 1.46 g of a 15% w/v solution of a poly(methyl methacrylate) in acetone were mixed together to form a clear solution, which was split into four equal portions of about 500 μl each. One of these portions, the control, was used as such; to the other three portions were added 3 mg of 2-methyl-5-phenylhydroquinone (MPHQ), 2,6-dichloro-1,4-benzoquinone (DCBQ) and 9,10-anthraquinone (AQ) respectively. Each of the portions was then coated on to a 4 mil poly(ethylene terephthalate) base with a coating rod, the coatings allowed to dry overnight, and a cover sheet was laminated over the coatings at about 220° F. (104° C.). The resultant films were imaged at writing speeds of 0.22, 0.25, 0.32 and 0.42 m/s and projected for 10 minutes in the same way as in Example 1, with the red optical densities being measured before and after projection. The results are shown in Table 9 below. FIG. 17 shows the variation of red optical density with writing speed, while FIG. 18 shows the change in optical density with initial red optical density.

Figure 16A:
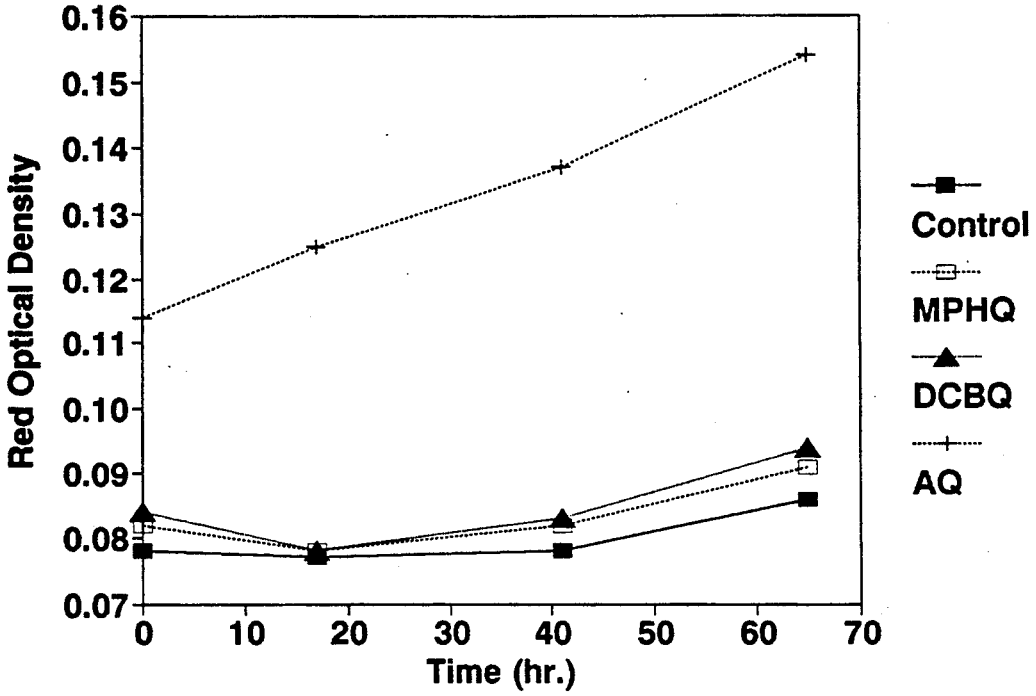
FIGS. 16A and 16B show the effects upon the red and visible minimum optical densities of a thermal imaging medium of this invention caused by addition of 2-methyl-5-phenylhydroquinone, 2,6-dichloro-1,4-benzoquinone and 9,10-anthraquinone, as described in Example 10 below.
Figure 16B:
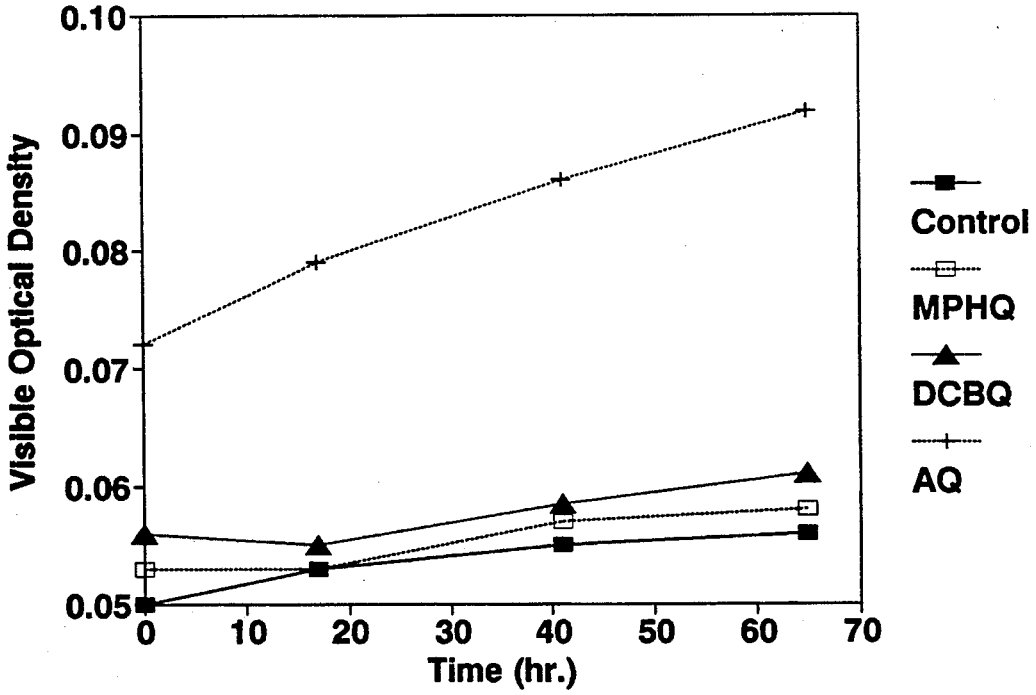

Also, the red and visible optical densities of unimaged portions of the four films were measured after imaging. The films were stored at 70° C. in an oven and these densities remeasured after 17, 41 and 65 hours storage. FIGS. 16A and 16B respectively show the variation of red and visible optical densities respectively with storage time.

TABLE 9

| Writing Speed, m/s | Control Initial Red Density | Control Change in O.D., % | MPHQ Initial Red Density | MPHQ Change in O.D., % | DCBQ Initial Red Density | DCBQ Change in O.D., % | AQ Initial Red Density | AQ Change in O.D., % |
|---|---|---|---|---|---|---|---|---|
| 0.22 | 3.49 | −10.0 | 4.08 | 2.2 | 3.69 | −1.8 | 4.47 | −2.5 |
| 0.25 | 3.24 | −7.6 | 4.07 | −0.9 | 3.55 | −2.8 | 4.24 | −6.1 |
| 0.32 | 2.30 | −16.1 | 2.66 | −3.7 | 2.38 | −5.2 | 2.59 | −18.7 |
| 0.42 | 0.86 | −19.2 | 0.82 | −8.0 | 0.89 | −3.1 | 0.84 | −26.3 |

From FIGS. 16A and 16B, it will be seen that MPHQ and DCBQ had only a minor effect on the red and visible optical densities of the film, and did not greatly affect its optical densities upon storage at elevated temperatures, whereas AQ markedly increased the optical densities both initially and upon storage at elevated temperatures.

Also, from FIGS. 17 and 18, it will be seen that MPHQ, DCBQ and AQ all increased the sensitivity of the medium, with AQ giving the greatest increase in sensitivity, and that MPHQ and DCBQ greatly reduced the projector fading of the images, whereas AQ conferred no such protection against projector fading.

From the foregoing it will be seen that the addition of a quinone or hydroquinone to the imaging layer of a thermal imaging medium in accordance with the present invention is effective in increasing the sensitivity of the imaging medium and in reducing projector fading of images produced therefrom.

We claim:

1. A thermal imaging medium comprising at least one imaging layer, the imaging layer comprising a binder and a color-forming compound which undergoes a change of color upon heating above a color-forming temperature for a color-forming time, the color-forming compound being of the formula:

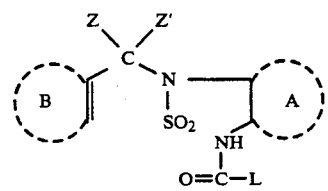

and forming after its change in color a dye compound of the formula:

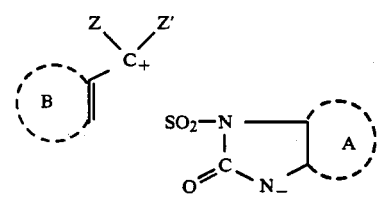

in which formulae:

rings A and B are aromatic nuclei;

Z and Z', which may be linked other than via the meso carbon atom, represent the moieties sufficient to complete the auxochromophoric system of a diarylmethane or a triarylmethane dye in the dye compound, Z and Z' being such that the dye compound has absorption in the visible region;

L is a leaving group which is removed on heating; and the broken line between the $SO_2$ group and ring B denotes that the sulfonamide ring in the color-forming compound may be 5- or 6-membered, the imaging layer further comprising a quinone or hydroquinone.

2. An imaging medium according to claim 1 wherein the imaging layer comprises a hydroquinone.

3. An imaging medium according to claim 2 wherein the hydroquinone has an electron withdrawing substituent on the aromatic ring bearing the two hydroxyl groups.

4. An imaging medium according to claim 3 wherein the or each electron withdrawing substituent comprises a halogen atom or an alkyl group.

5. An imaging medium according to claim 3 wherein the hydroquinone is chlorohydroquinone, 2,5-dichlorohydroquinone, 2-methyl-5-phenylhydroquinone, phenylhydroquinone or 2,5-di-t-butylhydroquinone.

6. An imaging medium according to claim 1 wherein the imaging layer comprises a total of at least about 0.25 mole of quinone or hydroquinone per mole of color-forming compound.

7. An imaging medium according to claim 6 wherein the imaging layer comprises a total of at least about 0.5 mole of quinone or hydroquinone per mole of color-forming compound.

8. An imaging medium according to claim 1 wherein, in the color-forming and dye compounds, Z and Z' each comprise a benzene ring, Z and Z' being linked via an oxygen atom bonded to the two benzene rings at positions ortho to the meso carbon atom, so that the Z—C—Z' grouping forms a xanthene nucleus.

9. An imaging medium according to claim 8 wherein the benzene rings of Z and Z' carry substituted amino groups at positions para to the meso carbon atom.

10. An imaging medium according to claim 1 wherein, in the color-forming compound, ring A comprises a benzene ring bearing, at its position para to the sulfonamide nitrogen atom, a carbamate moiety.

11. An imaging medium according to claim 1 wherein the color-forming compound comprises:

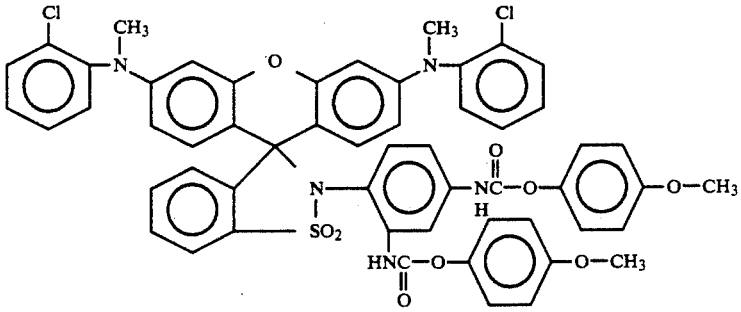

or

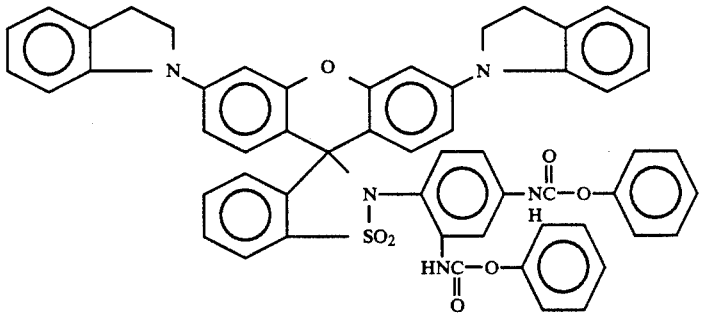

12. An imaging medium according to claim 1 wherein the color change of the color-forming compound is from colorless to colored.

13. An imaging medium according to claim 1 further comprising an absorber capable of absorbing infra-red radiation and thereby generating heat in the imaging layer and promoting the color change of the color-forming compound.

14. An imaging medium according to claim 13 having at least two imaging layers, the at least two imaging layers comprising color-forming compounds arranged to produce dye compounds having differing colors, and comprising at least two absorbers absorbing at differing wavelengths.

15. A process for forming an image, the process comprising:

providing a thermal imaging medium having at one imaging layer, the imaging layer comprising a binder and a color-forming compound of the formula:

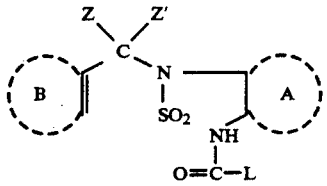

and a quinone or hydroquinone;

imagewise heating the imaging layer above a color-forming temperature for a color-forming time, thereby causing, in heated regions of the image, at least part of the color-forming compound to be converted to a dye compound of the formula:

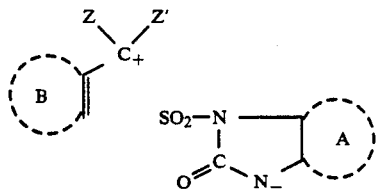

in which formulae:

rings A and B are aromatic nuclei;

Z and Z', which may be linked other than via the intervening carbon atom, represent the moieties sufficient to complete the auxochromophoric system of a diarylmethane or a triarylmethane dye in the dye compound, Z and Z' being such that the dye compound has absorption in the visible region;

L is a leaving group which is removed on heating; and the broken line between the $SO_2$ group and ring B denotes that the sulfonamide ring in the color-forming compound may be 5- or 6-membered, thereby forming an image.

16. A process according to claim 15 wherein the imaging layer comprises a hydroquinone.

17. A process according to claim 16 wherein the hydroquinone has an electron withdrawing substituent on the aromatic ring bearing the two hydroxyl groups.

18. A process according to claim 17 wherein the or each electron withdrawing substituent comprises a halogen atom or an alkyl group.

19. A process according to claim 17 wherein the hydroquinone is chlorohydroquinone, 2,5-dichlorohydroquinone, 2-methyl-5-phenylhydroquinone, phenylhydroquinone or 2,5-di-t-butylhydroquinone.

20. A process according to claim 15 wherein the imaging layer comprises a total of at least about 0.25 mole of quinone or hydroquinone per mole of color-forming compound.

21. A process according to claim 20 wherein the imaging layer comprises a total of at least about 0.5 mole of quinone or hydroquinone per mole of color-forming compound.

22. A process according to claim 15 wherein, in the color-forming and dye compounds, Z and Z' each comprise a benzene ring, Z and Z' being linked via an oxygen atom bonded to the two benzene rings at positions ortho to the meso carbon atom, so that the Z—C—Z' grouping forms a xanthene nucleus.

23. A process according to claim 22 wherein the color-forming compound comprises:

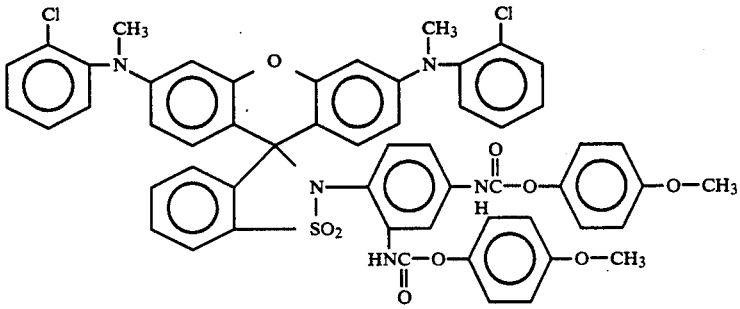

or

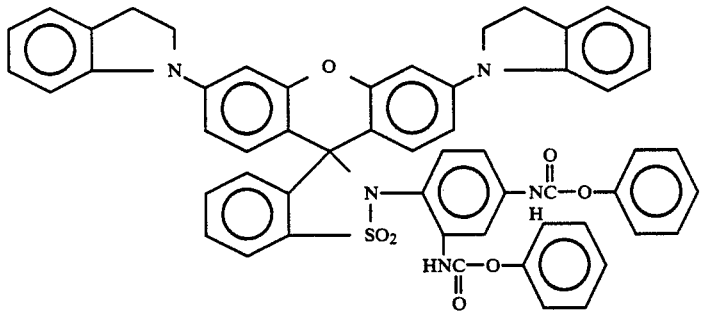

24. A process according to claim 15 wherein the imaging medium further comprises an absorber capable of absorbing infra-red radiation and thereby generating heat in the imaging layer, and wherein the imagewise heating of the imaging layer is effected by imagewise exposure of the imaging medium to infra-red radiation.

25. A process according to claim 24 wherein the imaging medium has at least two imaging layers, the at least two imaging layers comprising color-forming compounds arranged to produce dye compounds having differing colors, the imaging medium further comprising at least two absorbers absorbing at differing wavelengths, and wherein the at least two imaging layers are independently imaged by imagewise exposure of the imaging medium to infra-red radiation of at least two differing wavelengths capable of being absorbed by the absorbers.

26. A process according to claim 15 wherein the image produced is projected by passing visible radiation through the image and wherein the quinone and/or hydroquinone present in the imaging medium reduces fading of the image during projection.

27. An imaged medium having imagewise colored and substantially uncolored areas, the substantially uncolored areas of the image comprising a binder and a color-forming compound which undergoes a change of color upon heating above a color-forming temperature for a color-forming time, the color-forming compound being of the formula:

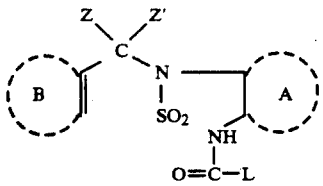

and the colored areas of the image comprising a binder and a dye compound of the formula:

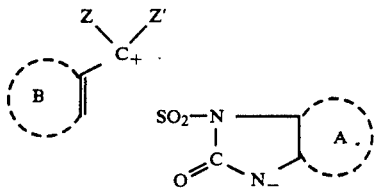

in which formulae:

rings A and B are aromatic nuclei;

Z and Z', which may be linked other than via the intervening carbon atom, represent the moieties sufficient to complete the auxochromophoric system of a diarylmethane or a triarylmethane dye, Z and Z' being such that the dye compound has absorption in the visible region;

L is a leaving group which is removed on heating; and the broken line between the $SO_2$ group and ring B denotes that the sulfonamide ring in the color-forming compound may be 5- or 6-membered, the colored and substantially uncolored areas further comprising a quinone or hydroquinone.

28. An imaged medium according to claim 27 wherein the colored and substantially uncolored areas comprise a hydroquinone.

29. An imaged medium according to claim 28 wherein the hydroquinone has an electron withdrawing substituent on the aromatic ring bearing the two hydroxyl groups.

30. An imaged medium according to claim 29 wherein the or each electron withdrawing substituent comprises a halogen atom or an alkyl group.

31. An imaged medium according to claim 29 wherein the hydroquinone is chlorohydroquinone, 2,5-dichlorohydroquinone, 2-methyl-5-phenylhydroquinone, phenylhydroquinone or 2,5-di-t-butylhydroquinone.

32. An imaged medium according to claim 27 wherein, in the substantially uncolored areas, the imaging layer comprises a total of at least about 0.25 mole of quinone and hydroquinone per mole of color-forming compound.

33. An imaged medium according to claim 32 wherein, in the substantially uncolored areas, the imaging layer comprises a total of at least about 0.5 mole of quinone or hydroquinone per mole of color-forming compound.

34. An imaged medium according to claim 27 wherein, in the color-forming and dye compounds, Z and Z' each comprise a benzene ring, Z or Z' being linked via an oxygen atom bonded to the two benzene rings at positions ortho to the meso carbon atom, so that the Z—C—Z' grouping forms a xanthene nucleus.

35. An imaged medium according to claim 27 wherein the color-forming compound comprises:

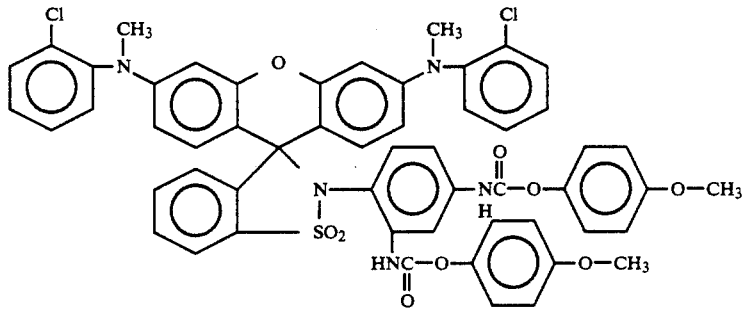

or

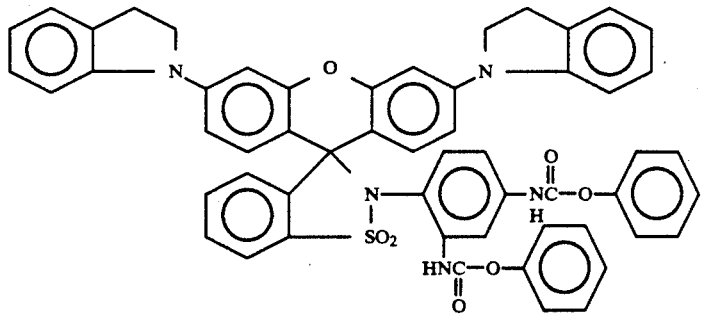

36. An imaged medium according to claim 27 wherein the substantially uncolored areas further comprise an absorber capable of absorbing infra-red radiation and thereby generating heat.

* * * * *